US012208304B2

(12) United States Patent
Akeel et al.

(10) Patent No.: US 12,208,304 B2
(45) Date of Patent: Jan. 28, 2025

(54) COMPACT HIGH RESISTANCE FITNESS DEVICE

(71) Applicant: Maxpro Fitness, LLC, Rochester, MI (US)

(72) Inventors: Nezar Akeel, Rochester, MI (US); Harold R Wilson, Holland, MI (US)

(73) Assignee: Maxpro Fitness, LLC, Rochester, MI (US)

( * ) Notice: Subject to any disclaimer, the term of this patent is extended or adjusted under 35 U.S.C. 154(b) by 624 days.

(21) Appl. No.: 17/259,728

(22) PCT Filed: Jul. 12, 2019

(86) PCT No.: PCT/US2019/041696
§ 371 (c)(1),
(2) Date: Jan. 12, 2021

(87) PCT Pub. No.: WO2020/014667
PCT Pub. Date: Jan. 16, 2020

(65) Prior Publication Data

US 2021/0339078 A1 Nov. 4, 2021

Related U.S. Application Data

(60) Provisional application No. 62/696,899, filed on Jul. 12, 2018.

(51) Int. Cl.
*A63B 21/00* (2006.01)
*A63B 21/005* (2006.01)
*A63B 21/16* (2006.01)
(Continued)

(52) U.S. Cl.
CPC ..... *A63B 21/4033* (2015.10); *A63B 21/0058* (2013.01); *A63B 21/153* (2013.01);
(Continued)

(58) Field of Classification Search
CPC ..... A63B 21/4033; A63B 21/1609; A63B 21/4035; A63B 21/0058; A63B 21/153;
(Continued)

(56) References Cited

U.S. PATENT DOCUMENTS 4,871,165 A * 10/1989 Marshall ..... A63B 21/00069 482/116
5,505,681 A * 4/1996 Bruggemann ..... A63B 21/153 482/904
(Continued)

FOREIGN PATENT DOCUMENTS

GB 2578416 A * 5/2020 ..... A63B 21/0442

*Primary Examiner* — Sundhara M Ganesan
*Assistant Examiner* — Jacqueline N L Loberiza
(74) *Attorney, Agent, or Firm* — Mark L. Maki; Miller Canfield

(57) ABSTRACT

A compact high resistance fitness device for superior independent exercising or individual rehabilitation is disclosed including a platform base plate having at least one pivotally mounted resistance module attached to the platform base plate, where the at least one resistance module has an independent user-selectable resistance setting with incremental resistance force ranges of from about 5 pounds up to 500 pounds. The resistance module includes a pull cord coil storage spool configured to wrap and unwrap a pull cord of a small diameter, high-strength pull cord emanating from the resistance module. The high strength pull cord terminates at its outer end by a handle, such as a hand/foot receptacle, with a length sufficient to allow pull strokes of up to fifty feet or more, with as much weight resistance as a user could want in a compact and portable unit, capable of being taken anywhere for use. Of special interest is that the fitness device may include sensors and other means for collecting data and relaying that data to a smartphone, a computer, the cloud or any other device for display and processing.

31 Claims, 31 Drawing Sheets

(51) Int. Cl.
*A63B 24/00* (2006.01)
*A63B 71/00* (2006.01)
*A63B 71/06* (2006.01)

(52) U.S. Cl.
CPC ..... *A63B 21/157* (2013.01); *A63B 21/1609* (2015.10); *A63B 21/4035* (2015.10); *A63B 24/0062* (2013.01); *A63B 24/0087* (2013.01); *A63B 71/0036* (2013.01); *A63B 2071/063* (2013.01); *A63B 2071/068* (2013.01); *A63B 2220/833* (2013.01); *A63B 2220/89* (2013.01)

(58) Field of Classification Search
CPC ..... A63B 21/157; A63B 24/0062; A63B 24/0087; A63B 71/0036; A63B 2071/063; A63B 2071/068; A63B 2220/833; A63B 2220/89
See application file for complete search history.

(56) References Cited

U.S. PATENT DOCUMENTS

| | | | | |
|---|---|---|---|---|
| 6,662,651 | B1 * | 12/2003 | Roth | A61B 5/224 73/379.02 |
| 9,320,936 | B1 * | 4/2016 | Rea | A63B 23/1209 |
| 10,471,297 | B1 * | 11/2019 | Smith | A63B 24/0087 |
| 2004/0204294 | A2 * | 10/2004 | Wilkinson | A63B 22/203 482/52 |
| 2010/0144496 | A1 * | 6/2010 | Schmidt | A63B 23/12 482/70 |
| 2014/0141949 | A1 * | 5/2014 | Mills | A63B 21/4045 482/140 |
| 2018/0021617 | A1 * | 1/2018 | Krull | A63B 21/023 482/128 |
| 2020/0001129 | A1 * | 1/2020 | Hsieh | A63B 21/015 |

* cited by examiner

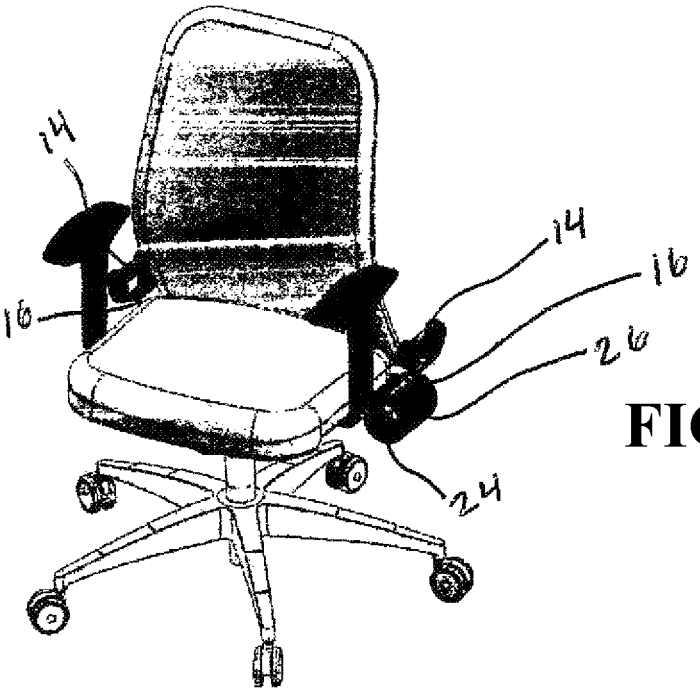
FIG. 8A
FIG. 8B
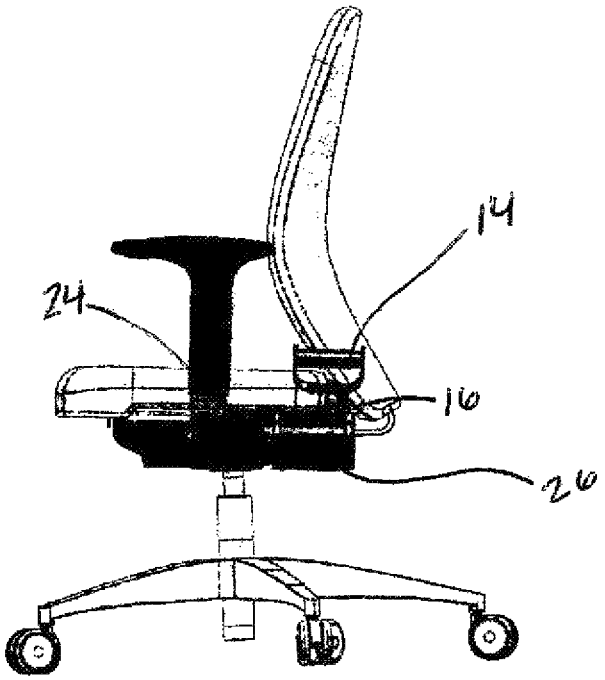

FIG. 8C
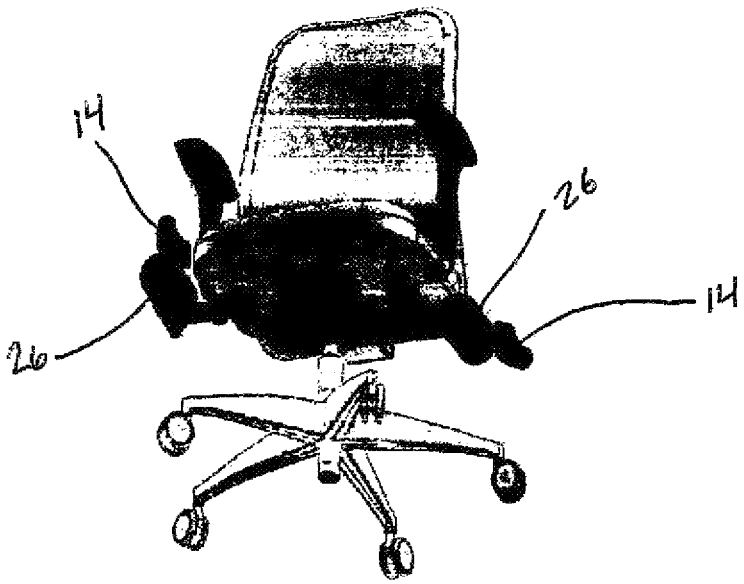
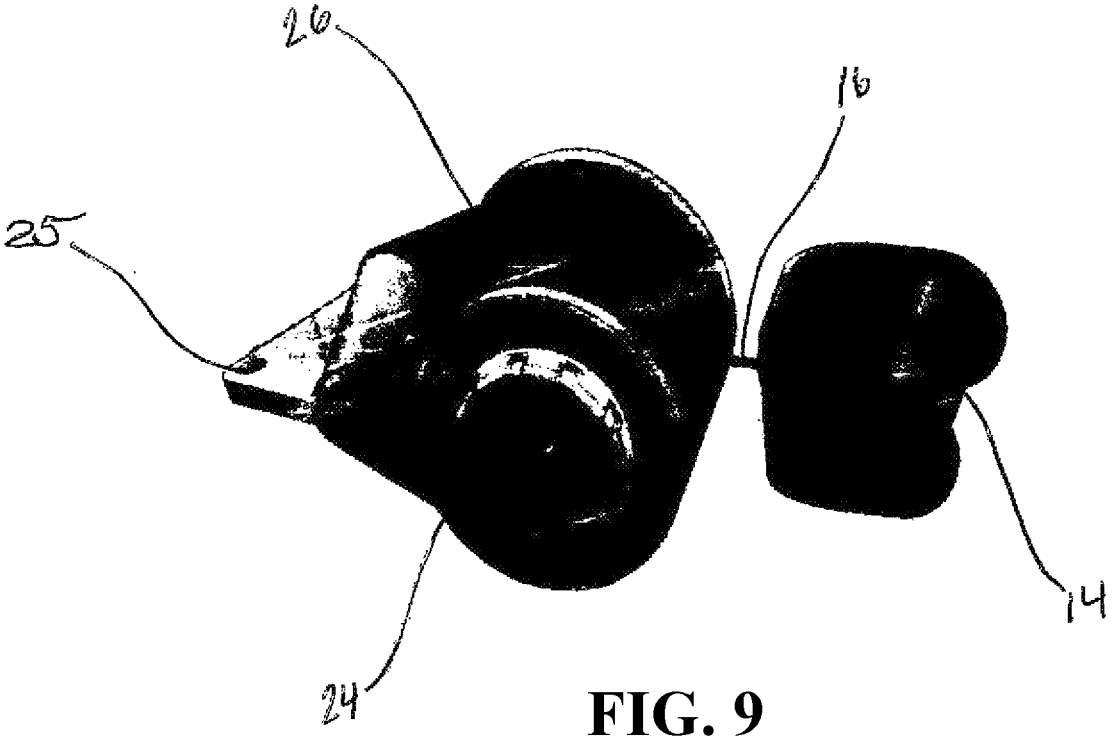
FIG. 9

• Smarthandle Subsystem

• Clutch Subsystem (Left// Right)

• Clutch Subsystem

COMPACT HIGH RESISTANCE FITNESS DEVICE

CROSS-REFERENCE TO RELATED APPLICATIONS

This application claims the benefit under 35 U.S.C. 119(e) of U.S. Provisional Application Ser. No. 62/696,899 filed on Jul. 12, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present invention relates to a compact fitness device, methods of manufacturing same, and methods of using same. More particularly, the present invention relates to a compact physical fitness device capable of generating a high level of resistance, especially one with a concentric exercise capability.

2. Description of the Prior Art

Traditional physical fitness exercise devices are well known in the art, including one of the most common types of resistance training techniques, including resistance exercise machines. Such devices are typically an exercise machine that either includes resistance weights or resistance elastic bands for exercising certain muscle groups. Such devices utilize both eccentric and concentric training. The eccentric phase is the lowering or negative portion of the exercise repetition, while the concentric phase is the lifting, shortening and/or positive portion of the repetition.

However, practitioners of those inventions have become aware of certain problems which were presented by those prior art inventions. Particularly in the field of physical therapy for muscular rehabilitation, and due to the aforementioned inclusion of an eccentric phase of the repetition in prior resistance devices, one can induce hypertrophy and edema. Both are undesirable conditions when one tries to develop atrophied or injured muscle tissue.

One additional particular problem that has plagued users has been that compactness and portability had to be sacrificed for adjustable resistance. Additional sacrifices precluded a wide range of resistance, and/or compatibility with full body exercises. For example, there are issues with the use of prior art resistance elastic bands, because the amount of resistance is limited. Moreover, resistance adjustability meant that one would have to carry around additional sets of elastic bands with handles attached that needed to be replaced in order to provide varying resistance to the exercise. Additionally, bands have the disadvantage of variable resistance depending on the length of stretch. Or, in another resistance technology of cable and pulley resistance type machines, they are large, heavy, stationary and often specialized for specific muscle groups. Yet another weight resistance technology includes the use of free weights. To use free weights, numerous plates of various and extremely heavy weights are necessary along with a bench and a bar to complete similar exercises. Free weights are neither compact, nor are they especially portable.

Furthermore, nothing in these types of prior art devices was able to relay meaningful data-driven information about the progress a person was making for strength by performing the exercise repetitions or provide personalized coaching instruction.

It would be desirable to the medical and sports industries if there was provided a truly compact and/or portable fitness device utilizing predominantly concentric phase training exercises. Especially desirable would be a compact fitness device that is also capable of monitoring, tracking and correlating the data indicative of the progress being made by the user, while providing coaching direction for further improvement. Further, it would be advantageous to provide an easy to manufacture method of making such a device, as well as a method of using the device to keep track of progress.

Sports medicine and physical therapies need to be monitored after injuries and/or accidents in order to inform doctors about readiness of the injured to return to work or to return to the sports field. Patients would benefit tremendously if their progress could be measured by constructive data, especially by means of a smartphone app with built-in algorithms.

SUMMARY OF THE INVENTION

In order to provide a suitable compact and/or portable physical fitness device capable of high resistance training, the present invention combines a number of novel features to provide a physical fitness device that has an impressive ratio of size of unit to the amount of resistance, which is adjustable from 5 to 500 pounds. The fitness device comprises an elongated platform having a pair of concentrically acting, independent resistance modules at opposing ends of the platform. These resistance modules are capable of providing a wide range of resistance, from low to very high. The high resistance capability is fully adjustable and may go all the way up to at least five hundred (500) pounds of resistance per side. The resistance modules each have a retractable pull cord terminating in a handle. The handle can be used by one's hand, foot, or any other body part that needs to be strengthened.

Especially useful is the optional integration of a number of electronic features for on-the-fly weight resistance adjustments, transmission of data to a smartphone, computer, or the Internet.

Another aspect of this fitness device may provide electromagnetic resistance by means of either DC braking of an AC motor, or the rotation of a brushless DC motor in the direction opposite to the rotation pull direction of the user.

Such electric DC braking coupled with user pre-selected resistance profiles allow a novel way for users to modify resistance during the actual exercise without further input or action from the user. This resistance could follow a pre-programmed or user personalized resistance profile, similar to a treadmill or exercise bike, to allow for maximum muscle stimulation. An example may include reducing/increasing resistance by 10% after rep 7, or ascending/descending resistance with every rep, or repetition, again without user input during the exercise.

BRIEF DESCRIPTION OF THE DRAWINGS

For a further understanding of the nature and advantages of the expected scope and various aspects of the present invention, reference shall be made to the following detailed description, and when taken in conjunction with the accompanying drawings, and wherein:

FIG. 8A is an illustration of another aspect of the invention, with a resistance module attached;

FIG. 8B is another view of the invention shown in FIG. 8*a;*

FIG. 8C is a close-up view of the resistance module with a mounting bracket;

FIG. 9 is a close-up view of the resistance module with a mounting bracket;

DETAILED DESCRIPTION OF THE INVENTION

Figure 1:
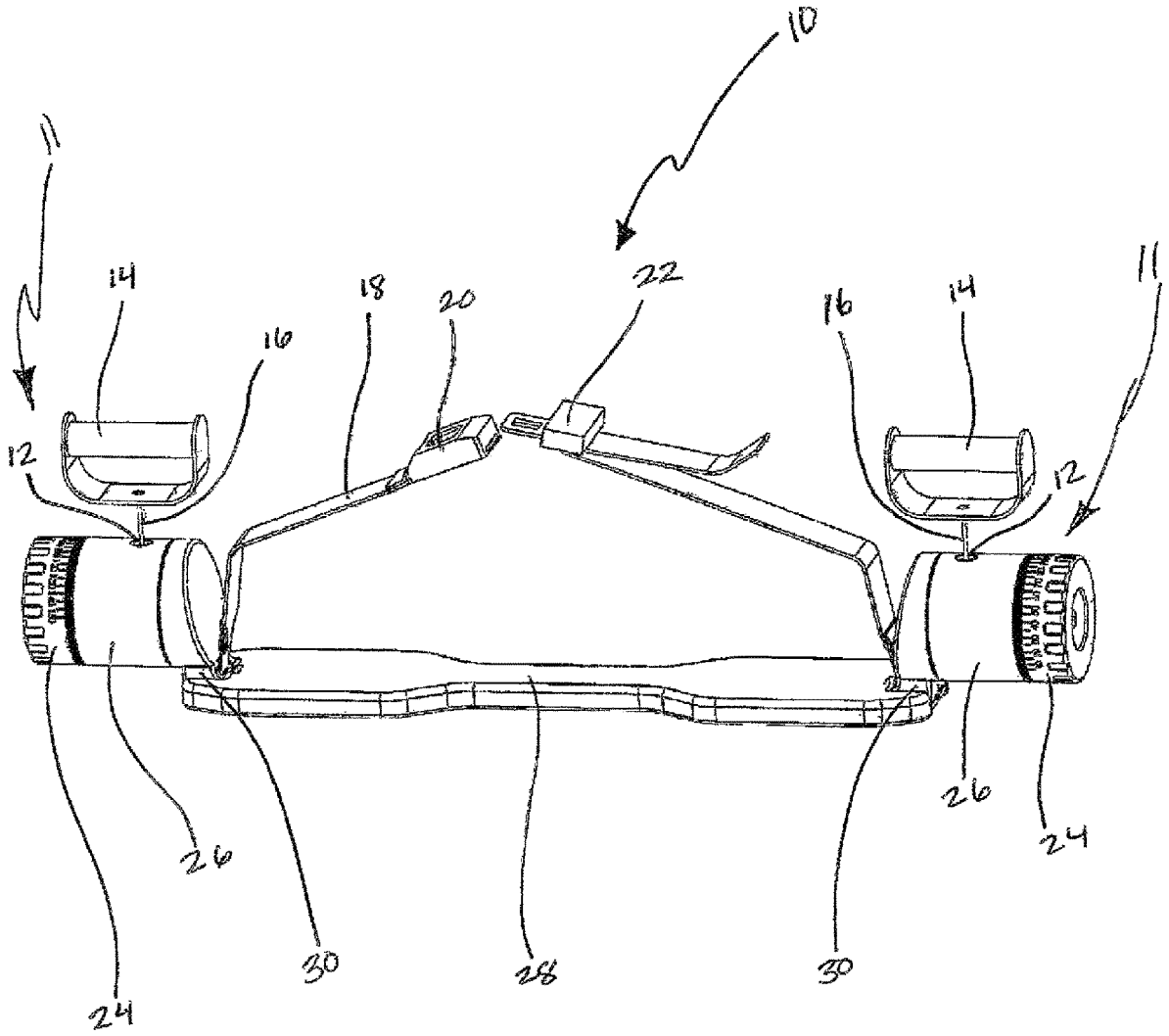
FIG. 1 is a perspective view of a Compact high resistance fitness device made in accordance with the present invention.

Generally, a compact high resistance fitness device 10 is disclosed which utilizes a platform base plate or support plate 28 including two small widely spaced pivotally mounted resistance modules 11 each having independent user-selectable resistance settings with very large force ranges (of possibly a low 5 pounds up to 500 pounds or more for example) and very long pull strokes while each achieving minimal in-stroke force increases or decreases. In use, the resistance modules 11 are spaced apart on a platform base plate 28 preferably at a distance that allows the user's shoulders to fit substantially between the two resistance modules 11. The resistance modules 11 each include a small diameter, high-strength resistance cord 16 terminated at the outer end by a hand/foot receptacle or handle 14 and with a length sufficient to allow pull strokes of up to eight feet or more. The resistance modules 11 include covers 54 that define barrels 26 and that can rotate to move the angle of a cord exit orifice or cord escape bushing 12 to minimize cord wear. A large user-actuated resistance force selector knob or resistance adjustment knob 24 includes incremental radial position marks that are labeled with a corresponding approximate resistance force value indication.

Figure 5:
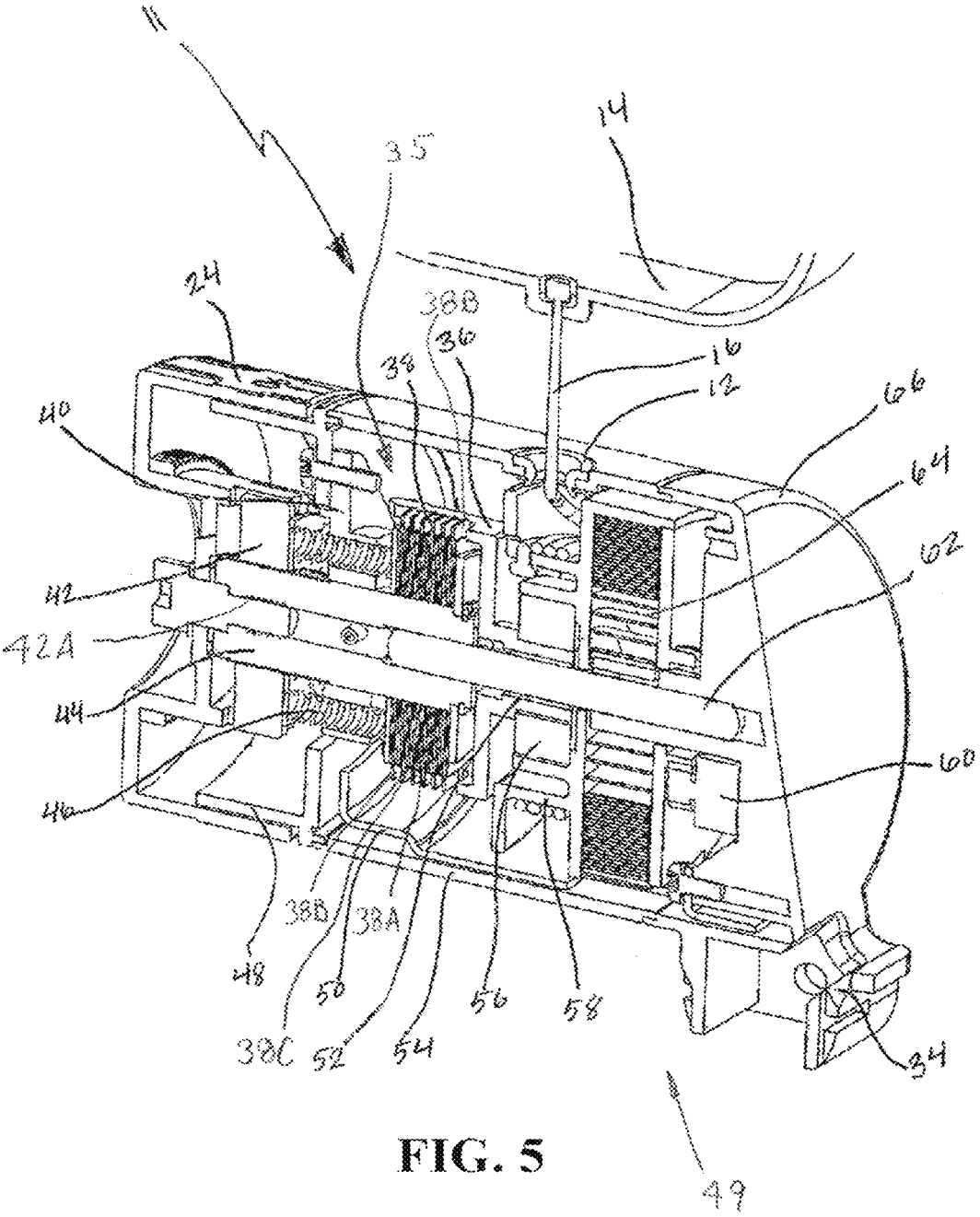
FIG. 5 is a cutaway view of a resistance module.

Although the entire force range from 5 to 500 pounds resistance may be selectable within one 360° rotation of the resistance force selector knob 24, it may also be selected by any angle of rotation from 0-180°, or it may be selected by means of a digital keypad and display in communication with a brushless DC (BLDC) motor described hereinafter. The lowest resistance force value is primarily contributed from the low-force spirally coiled rewind spring 64 (FIG. 5). From that value, the user may select additional resistance force by moving the force selection knob 24 to increase the friction between friction plates or slip plates 38 of an integral slip clutch 35 by moving a slip clutch plate driver 36. The friction plates or slip plates 38 comprise a stack of stationary friction plates or slip plates 38A and rotatable friction plates or slip plates 38B, which are relatively rotatable relative to the stationary friction or slip plates 38A during unwinding of the pull cord 16. The low-force spirally coiled rewind spring 64 automatically rewinds the pull cord 16 when the user relaxes his or her pull. The slip clutch 35 does not resist the rewind action due to the one-way bearing or cord spool bearing 56 decoupling the cord spool or cord storage spool 58 from the clutch plate driver 36. A rotary dampener or cord rewind speed control dampener 60 may be engaged with the cord spool 58 to control the speed of the cord rewind cycle. Each resistance module 11 may be independently pivoted 180° from a locked in-use position to a locked storage position which reduces the overall length of the assembly as described further herein relative to FIG. 2. The compact high resistance fitness device 10 includes structures for removable attachment of belts 18 to be used to restrain and offset the pull forces when not restrained fully by the user's own body mechanics. Resistance modules 11 include features that allow paired resistance modules 11 to be assembled as right-hand and left-hand units where the pull cord 16 and the rewind spring 64 are reverse wound in one unit of the pair of resistance modules 11 as compared with the other unit of the pair.

Figure 3:
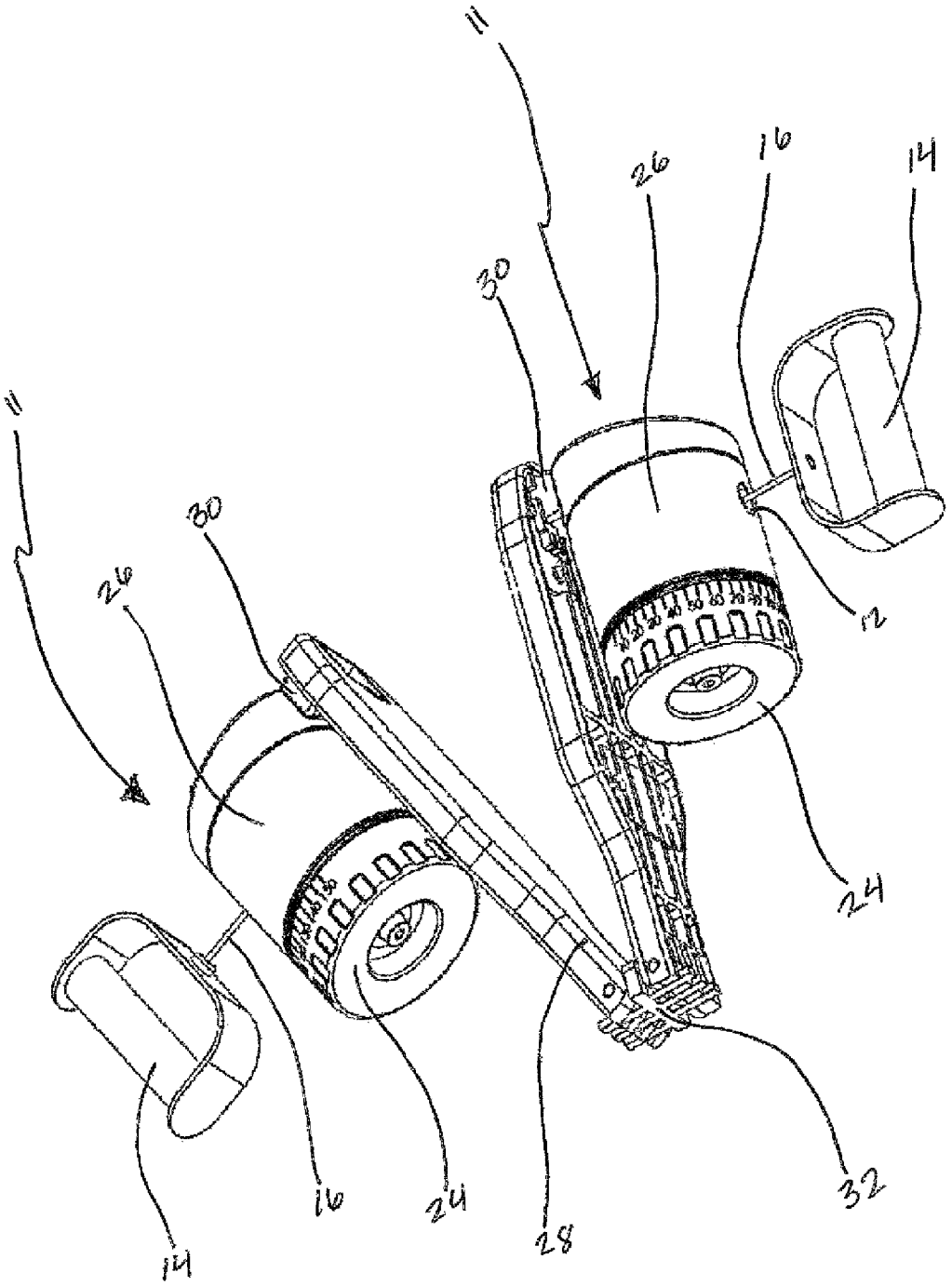
FIG. 3 is a perspective view of a folded Compact high resistance fitness device with rotated resistance modules into storage position.

Some versions of the compact high resistance fitness device 10 will include a base plate 28 of segments or sections as seen in FIG. 3 having additional pivot joints, i.e. a support plate hinge 32, to allow the base plate segments to fold into a smaller volume compact high resistance fitness device 10 transportable package. Other versions of the instant compact high resistance fitness device 10 may include a platform base plate of segments that telescopically slide together to reduce the length of the assembly for transport. Further, it may be adjusted to accommodate various user sizes.

Any of the compact high resistance fitness device aspects herein can include electronic sensors, circuitry, a CPU and communication devices that allow the Compact high resistance fitness device 10 to record the number and length of pull strokes, set the resistance force of each stroke and compile these values from each of the two resistance modules 11 and transmit this information to a receiving device that will record and display the information to the user. The resistance modules 11 communicate wirelessly between modules and one module 11 will be designated to communicate wirelessly with a receiving display device. (See FIGS. 10-13)

A chair may be substituted for a portion of the base plate to allow a pair of right-hand, left-hand resistance modules to be mounted to the chair, one unit on each side, near the height of the seat as seen in FIGS. 8A, 8B and 8C. Additional structures are provided to allow the respective resistance modules to pivot to allow the pull cord exit orifice 12 (not numbered in FIGS. 8A-8C) to face forward and/or upward with respect to the user occupied chair. The mounted resistance modules 11 will preferably rotate with the user as the chair swivels. In addition, the mounting can be made to any other stable fixture point, such as a table leg, a railing, a hospital bed, or the like.

The present invention uniquely focuses on concentric only training, unlike any other form of resistance training. Other resistance training techniques incorporate both eccentric and concentric forms of resistance training. The present invention removes the eccentric part of an exercise while still eliciting a training effect but significantly reduces potential muscle soreness and recovery time. Primarily concentric training provides for safer strengthening of muscles.

Generally, a repetition consists of two distinct phases. Using the classic bicep curl exercise as an example here:

1. the eccentric phase is the lowering or negative portion of the repetition. In our example this would be moving the weight from the shoulder down towards the thigh. The biceps group then lengthens under tension; and
2. The concentric phase is the shortening or positive portion of the repetition. Our example would see the raising of the weight from the thigh towards the shoulder. The biceps group then shortens under tension.

Concentric muscle workouts have some significant benefits, increasing blood flow through the muscle, providing a level of hypertrophy, but with minimal or no edema or swelling of the muscle which can delay onset muscle soreness. Concentric-only strength training may be an efficient way to increase muscle hypertrophy without edema and eccentric muscle damage.

The eccentric phase of an exercise causes the most damage and carries the greatest potential for soreness. While the eccentric phase is much more demanding on the body and the central nervous system, it also takes longer to recover. This can be particularly important for patients recovering from muscle related injuries during physical rehabilitation. Previously known exercise devices on the market involve concentric and eccentric use of the muscle. The present invention is unique because it provides an eccentric-less form of training.

In its basic format, the present invention discloses a compact high resistance fitness device 10 that includes a platform base plate 28 having at least one resistance module 11, but may also include two widely spaced pivotally mounted resistance modules 11 at opposing ends of the platform base plate. Each resistance module 11 has independent user-selectable resistance settings with incremental resistance force ranges of from about 5 pounds up to 500 pounds. This is a large advantage over prior art devices, because they have not been able to achieve such a high level of resistance in such a compact device. Regarding the resistance module location, it may be positionable between up, middle, and down positions, depending on what exercise or rehabilitation mode is desired. For instance, if the compact fitness device 10 is mounted on a wall to exercise upper body parts, the resistance module 11 would preferably be mounted in a way to accommodate that. If, on the other hand, a person wished to only rehabilitate their legs, the resistance module would be mounted or placed on the floor such that one's feet held the present fitness device in the proper position. Further, the compact fitness device made in accordance with the present invention may preferably be mounted on a fitness stand or a stationary track, whether any of these can be wall mounted or not. For general exercising use, the length of the platform base plate is sufficient to allow space for the user's shoulders to fit between the resistance modules in the in-use position.

Each resistance module 11 includes a pull cord coil storage spool 58 configured to wrap and unwrap a pull cord 16 of a small diameter, high-strength pull cord emanating from the resistance module 11. The high strength pull cord 16 may be up to at least 50 feet, and it terminates at its outer end by a hand/foot handle, or receptacle, 14 with a length sufficient to allow pull strokes of up to fifty feet or more. In certain aspects, it may be preferable for the pull cord coil storage spool 58 to be V-shaped.

A rotatable housing 54 defines a barrel 26 and externally covers the at least one resistance module 11. The housing 54 has a cord escape port orifice 12 for directing and delivering the high-strength cord 16. The housing cover 54 can rotate about the resistance module 11 to move the cord exit orifice angle to minimize cord wear. In the various aspects, i.e. a single resistance module 11 or the dual resistance modules 11, a user-actuated resistance force selector knob 24 may be made integral with the housing cover 54, and the resistance force selector knob 24 will include incremental radial position marks that are labeled with a corresponding approximate resistance force value indicator. The resistance module 11 may be self-winding, or it may include a return spring, a motorized or manual retraction system, and/or it may be programmable to be retracted in a pre-determined fashion. Further, the resistance module 11 may be a non-momentum, non-resisting resistance device, and it may be a locking device. The resistance module 11 may further include a potentiometer for adjusting resistivity to any level for exercise or rehabilitation Any commercially available electronic controls, such as Hall sensors, may be used for possible scenarios to control the resistivity or any other aspect of the present invention.

In further aspects of the present invention, the compact high resistance fitness device 10 may include at least one resistance module 11 including sensors for momentum, direction, and biometrics for procuring data to be processed by an IoT connectivity app to provide data communication through connectivity apps as described herein. The IoT connectivity app provides numerous capabilities for programmability options, depending on which sensors are included. Such sensors are commercially available and provide any number of possible data collection capabilities. Once data collection is enabled by the use of non-electronic, electronic means or by the incorporation of sensors, the resistance module may be controlled manually, electronically, by computer or by voice actuation. In another aspect, our fitness device may further comprise an audio capable speaker for listening to instructions from a coaching app. The compact high resistance fitness device may also include at least one wireless transmission and receiver to relay data and information to a smartphone, a computer, up into the cloud, or any other desirable receiver for data. Each of the components, including the handles or foot holds, may become smart handles with sensors embedded therein for relaying medical data. Various commercially available biometric devices can also be incorporated into the smart handles to monitor things like blood pressure, temperature, even cholesterol or blood sugar levels.

When collection of the data is desired, the resistance module may include electronic sensors, circuitry, a CPU and/or communication devices that allow the compact high resistance fitness device to record the number and length of pull cord strokes, the set resistance force of each said pull cord stroke and compile these values from the at least one resistance module and transmit this information to a receiving device that will record and display the information to the user. Where two resistance modules 11 are being used, the resistance modules 11 may communicate wirelessly between modules and one module will be designated to communicate wirelessly with a user supplied receiving device.

Figure 30:
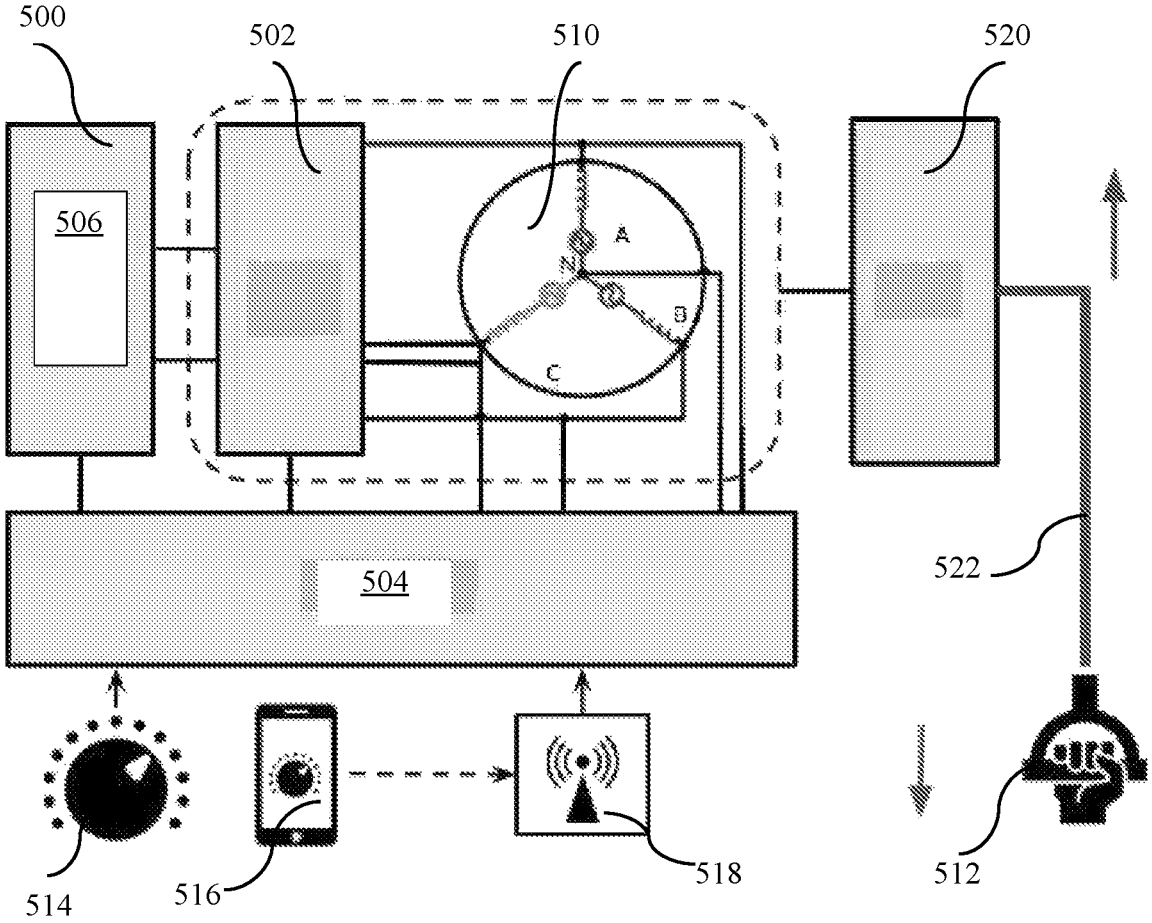
FIG. 30 is a functional block diagram of the data-transfer electronic circuitry.

In a second aspect, for certain fitness applications, where the pull cord 16 may be desired to be relatively longer, it may be preferable to eliminate any return spring, and may include a motor 510, perhaps with a remote control, to retract the pull cord 16 as described herein relative to FIG. 30. Of course, a manual retraction unit is also feasible. Furthermore, the motor 510 may be programmable, again to be retracted in a pre-determined fashion.

The compact high resistance fitness device 10 may be easier to store if the resistance modules 11 can be moved from a locked in-use position to a locked storage position and wherein said locked storage position reduces the overall length of said fitness device 10 by approximately the combined length of the two resistance modules 11 as will be described relative to FIG. 3.

Figure 18:
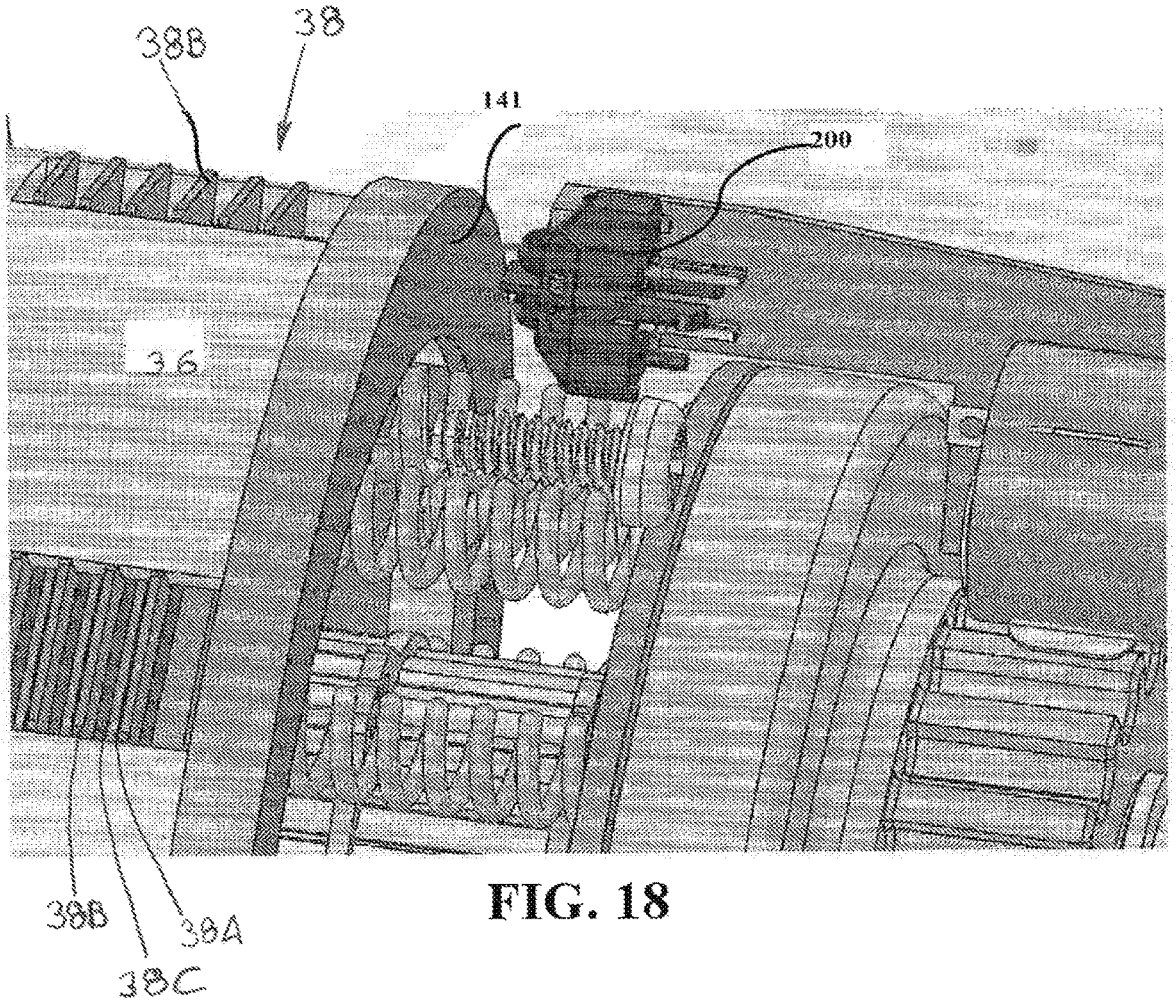
FIG. 18 is a close up view of the spring mechanism.

The compact high resistance fitness device 10 also is envisioned of having an aspect further including a rotatable slip clutch 35 in the resistance modules 11 that includes a plurality of friction plates 38A and 38B spaced apart by one of a plurality friction disks 38C (best illustrated in FIGS. 5 and 18). In this aspect, the friction disks 38C contact one moving or rotatable friction plate 38B on one side and one stationary friction plate 38A on the opposite side and the plurality of friction plates 38A and 38B and friction disks or friction pads 38C are pressed together by a plurality of compression springs 46. In effect, this configuration forms a stack of stationary friction plates 38A and rotatable friction plates 38B that are engaged with friction pads 38C therebetween. In this configuration, rotation resistance of the rotatable slip clutch 35 is varied by reducing the length of the plurality of compression springs 46 and thereby increasing the force of the plurality of compression springs 46 on said plurality of friction plates 38A and 38B.

In accordance with yet another aspect of the present invention, a desirable compact high resistance fitness device 10 is adapted for resistance force exercise with a base plate or support plate 28 and at least one resistance module 11 mounted on the base plate 28. In this aspect of the invention, the fitness device 10 includes a frame structure 49 comprising an inner support frame 50 fixed with an inner end housing 66, an axle shaft or axle pin 62 rigidly mounted to the frame structure 49 on the inner end housing 66, a one-way clutch bearing 56 mounted to the axle shaft 62, a user adjustable resistance force adjustment knob 24, and a variable resistance rotary slip-clutch 35 having the stack of stationary friction plates 38A and rotatable friction plates 38B that are engaged with friction pads 38C therebetween. The rotatable friction plates 38B are preferably pivotally engaged with the one-way clutch bearing 56 while the stationary plates are non-rotationally mounted to the frame structure 49 through the axle shaft 62. A user extendable pull-cord 16, and a cord storage spool 58 are pivotally mounted to the axle shaft 62 and it is engaged with the one-way clutch bearing 56.

A rotatable outer cover 54 over the storage spool 58 includes a pull-cord escape port or cord escape bushing 12, where the user extendable pull-cord 16 terminates at the outer end by a user actuated receptacle 14. The pull-cord 16 preferably has a length sufficient to allow pull-strokes of 12-inches or more, preferably to about 8 feet long, although pull strokes of 50 feet or more may be desirable. A portion of the pull-cord 16 passes through the pull-cord escape port 12 while the inner end thereof is attached to the cord storage spool 58 to prevent pulling the cord 16 out of the device 10. The outer cover 54 is preferably pivotally mounted to the frame structure 49 comprising the inner end housing 66 so that the axis of the rotatable outer cover 54 is substantially aligned with the axis of said axle shaft 62. With the compact high resistance fitness device 10 held stationary, rotation of the user adjustable resistance force adjustment knob 24 is engaged to set the adjustable resistance of the slip-clutch 35. When the user pulls on the handle 14, the extension of the pull-cord 16 rotates the spool 58, and the spool 58 rotates the one-way bearing 54 in the locked direction which rotates the rotary clutch plates 38B which are being resisted by friction of engaged clutch friction plates 38A and friction pads 38C. Rewinding of the pull-cord 16 onto the cord storage spool 58 in the unlocked direction of the one-way bearing 56 thereby disengages the rotary clutch plates 38B while the pull-cord 16 is being rewound onto the cord storage spool 58. As further described herein, there are several different mechanisms for retracting the pull cord 16, whether manually, or by a motor 510.

In this aspect, a spirally wound rewind spring 64 is connected at the outer end to the cord storage spool 58 and is attached at the inner end to the frame structure 49. The rewind spring 64 is employed to power the rewinding of the pull-cord 16.

The friction between the clutch friction plates 38A and 38B and the friction pads 38C results from pressure applied by compression springs 46 on the stack of friction plates 38A and 38B.

In further aspects of the present invention, the adjustable resistance force adjustment knob 24 may include an internal thread 42A formed on a threaded spring compression collar 42 that causes the compression springs 46 to be compressed when the knob 24 is turned in one direction.

Referring now to the drawings in detail, FIG. 1 is a perspective view of a first aspect of a compact high resistance fitness device, generally denoted by the numeral 10, including opposing handles 14 emanating from resistance cord escape bushings 12 by resistance cords 16. In this aspect, a restraining belt 18 is secured to a support plate 28 and may optionally include a restraining belt buckle housing 20, releasably attached by restraining belt buckle latch 22. Hingeably attached to opposite ends of support plate 28 are two resistance modules 11. Resistance modules 11 include a resistance adjustment knob 24 at the distal end of rotatable barrel 26. In practice, a user may want to exercise his arms, and would place support plate 28 against the back of a chair and lean up against support plate 28 before extending handles 14 to exercise the user's arms. An optional restraining belt 18 may be secured across the chest of the user by restraining belt buckle housing 20 and restraining belt buckle latch 22.

In this aspect, at least one resistance module 11 is in communication with resistance cord 16 being attached to handles 14. A resistance cord escape bushing 12 directs resistance cord 16 and provides minimal frictional damage to resistance cord 16. A resistance module 11 is hingeably attached to support plate 28 for ease of storage, and is enabled to swing underneath support plate 28 by module hinges 30 so that the Compact high resistance fitness device 10 takes up less space for storage.

Figure 2:
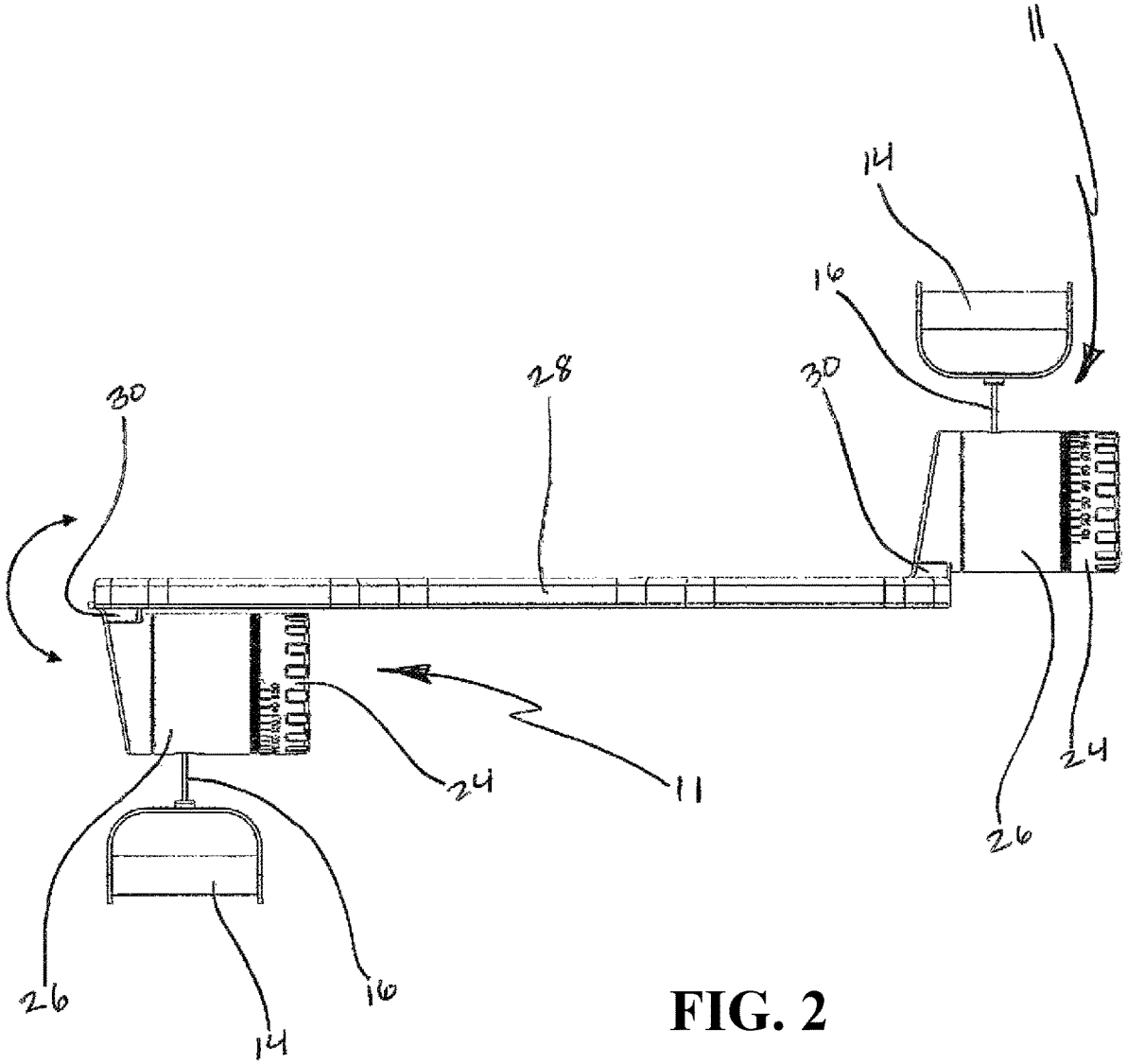
FIG. 2 is a top plan view of a Compact high resistance fitness device displaying a rotated resistance module.

FIG. 2 illustrates one of the resistance modules 11 swung underneath support plate 28, while being hingeably attached. In this illustration, one of the resistance modules 11 has been swung down under support plate 28 while the other resistance module 11 is still shown in the up position on top of support plate 28. Resistance module 11 is hingedly attached to barrel 26 by hinge 30. Resistance knob 24 indicates the amount of resistance desired. Pull cord 16 terminates in handle 14, which the user pulls for the exercise.

FIG. 3 illustrates yet another configuration of the present invention illustrated the unit being folded for easy portable transportation. Support plate 28 is divided into two equal sections, and hingeably attached to one another by support plate hinge 32. In this diagram, the relative positions of resistance modules 11 may be rotated 90° back underneath support plate 28 for easy storage. Handles 14 and barrels 26 are tucked away for storage purposes. This optional configuration does not affect the performance of the at least one resistance module 11, nor is the resistance adjustment knob 24 or the position of barrels 26 being affected. Pull cord 16 is activated by the user once resistance modules 11 are moved into the desired position by hinges 30.

Figure 4A:
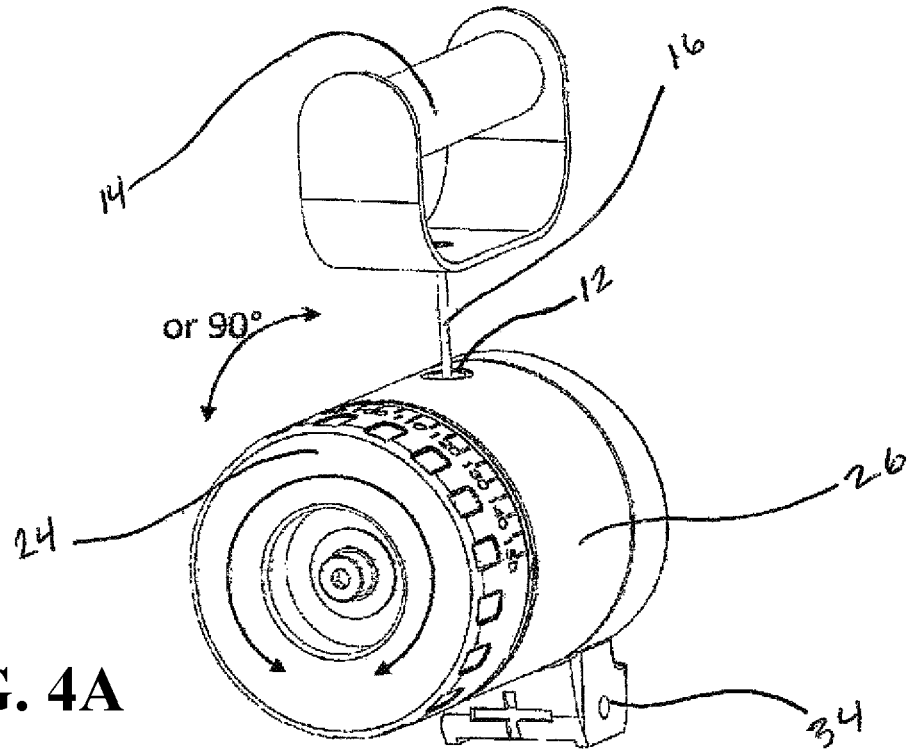
FIG. 4*a* is a perspective view of a resistance module.
Figure 4B:
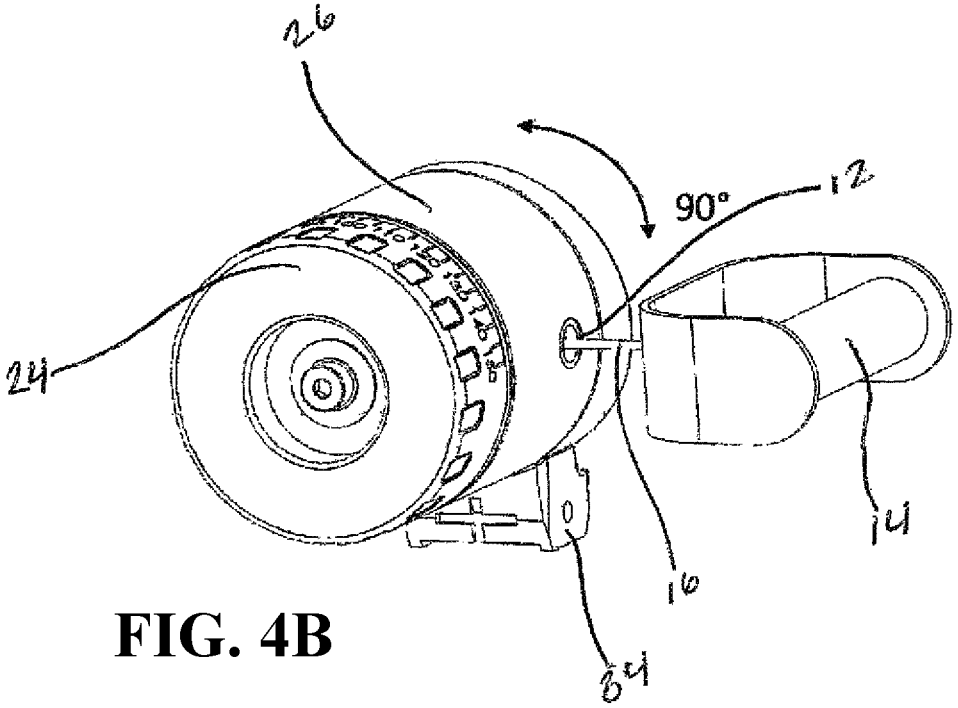
FIG. 4*b* is a perspective view of a resistance module rotated at a ninety-degree angle.

With combined reference to FIGS. 4*a* and 4*b*, the rotatable nature of barrel 26 is shown such that handle 14 may be pulled in any direction so that resistance cord 16 comes out of resistance cord escape bushing 12 without damage. Resistance knob 24 is located in the desired position to generate the proper amount of resistance. FIG. 4*a* shows the tension cord 16 being pulled in a direction which lines up with module hinge connector 34. In FIG. 4*b*, barrel 26 has been rotated 90° with respect to module hinge connector 34 so that resistance cord 16 is not being pulled freely through resistance cord escape bushing 12.

FIG. 5 is a cutaway perspective of the inner workings of at least one resistance module 11. As handle 14 draws resistance cord 16 through resistance cord escape bushing 12, resistance cord 16 rolls off of cord storage spool 58 which is advanced by one-way cord spool bearing 56. Rotatable cover 54 acts as a housing for not only cord storage spool 58 but also for slip clutch plate driver 36 and slip clutch slip plates 38 comprising the stationary friction plates 38A and rotatable friction plates 38B as well as the friction pads 38C. Inner support frame 50 houses slip clutch slip plates 38 and cord storage spool 58. Spring guide and clutch arbor support 40 supports threaded spring pressure collar 42 having internal threads 42A which is supported by slip clutch threaded arbor 44 and secures slip clutch plate pressure springs 46. Outer end housing 48 allows resistance adjustment knob 24 to rotate, thereby rotating the spring pressure collar 42 and pressurizing each slip clutch plate pressure spring 46. Resistance module 11 may be secured to support plate (not shown here) by module hinge connector 34. Cord rewind speed control dampener 60 surrounds cord spool axle pin or axle shaft 62 which is surrounded by spirally coiled cord rewind spring 64 within inner end housing 66.

Figure 6:
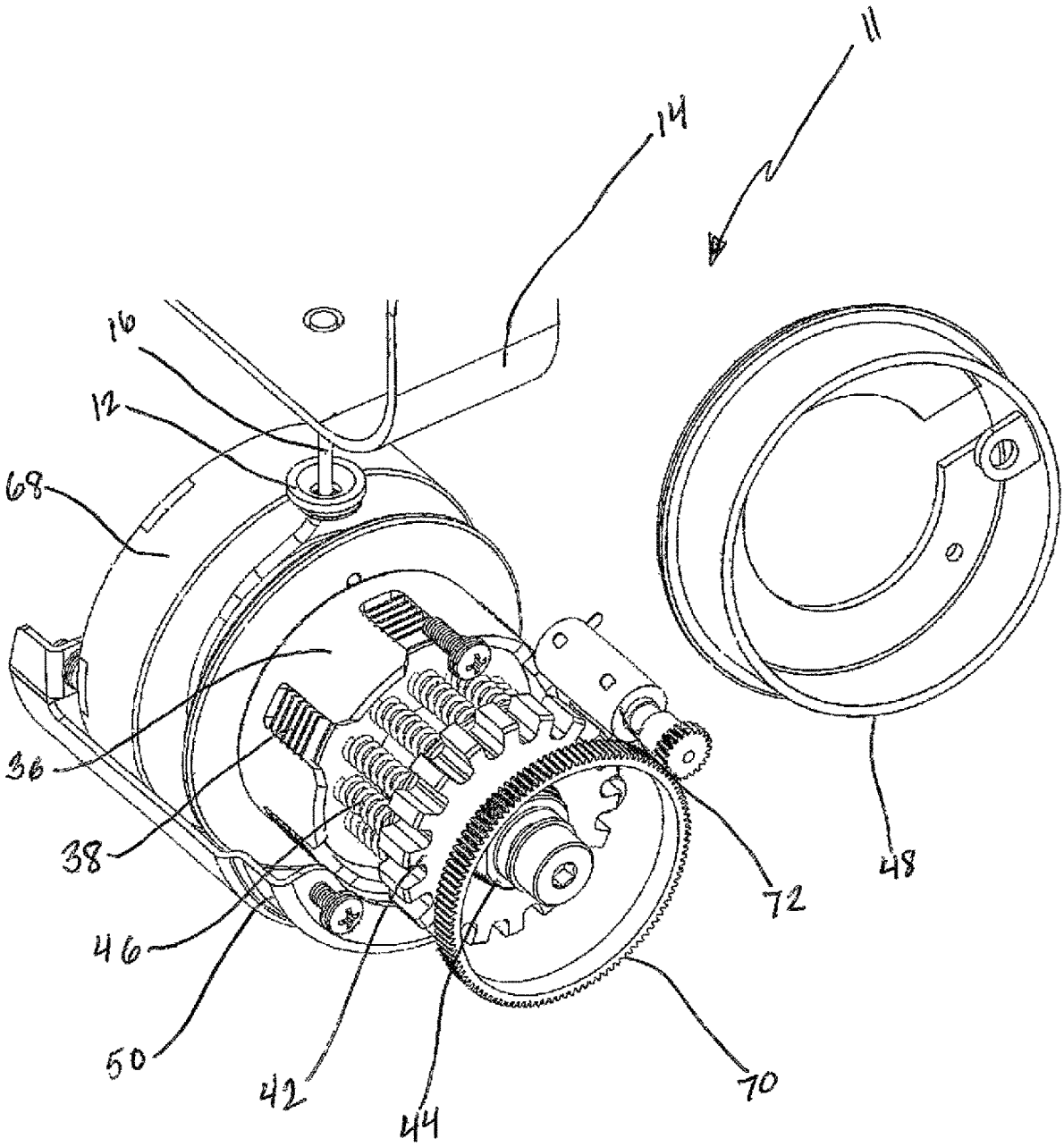
FIG. 6 is a perspective view of a slip clutch without the cover on it.

FIG. 6 shows another view of the resistance module 11 of FIG. 5, and using like element numbers shows outer end housing 48 separated from around slip clutch plate pressure spring 46. Slip clutch threaded arbor 44 extends axially through threaded spring pressure collar 42 and slip clutch plate driver 36 with slip clutch slip plate 38 inner support frame 50 supports the slip clutch assembly. Cord storage spool and spirally coiled cord 68 provides a housing for resistance cord 16 extending through resistance cord escape bushing 12 and is attached to handle 14. At the distal end of the slip clutch assembly is resistance adjustment knob inner gear portion 70 in communication with rotating electromechanical position sensor 72.

Figure 7:
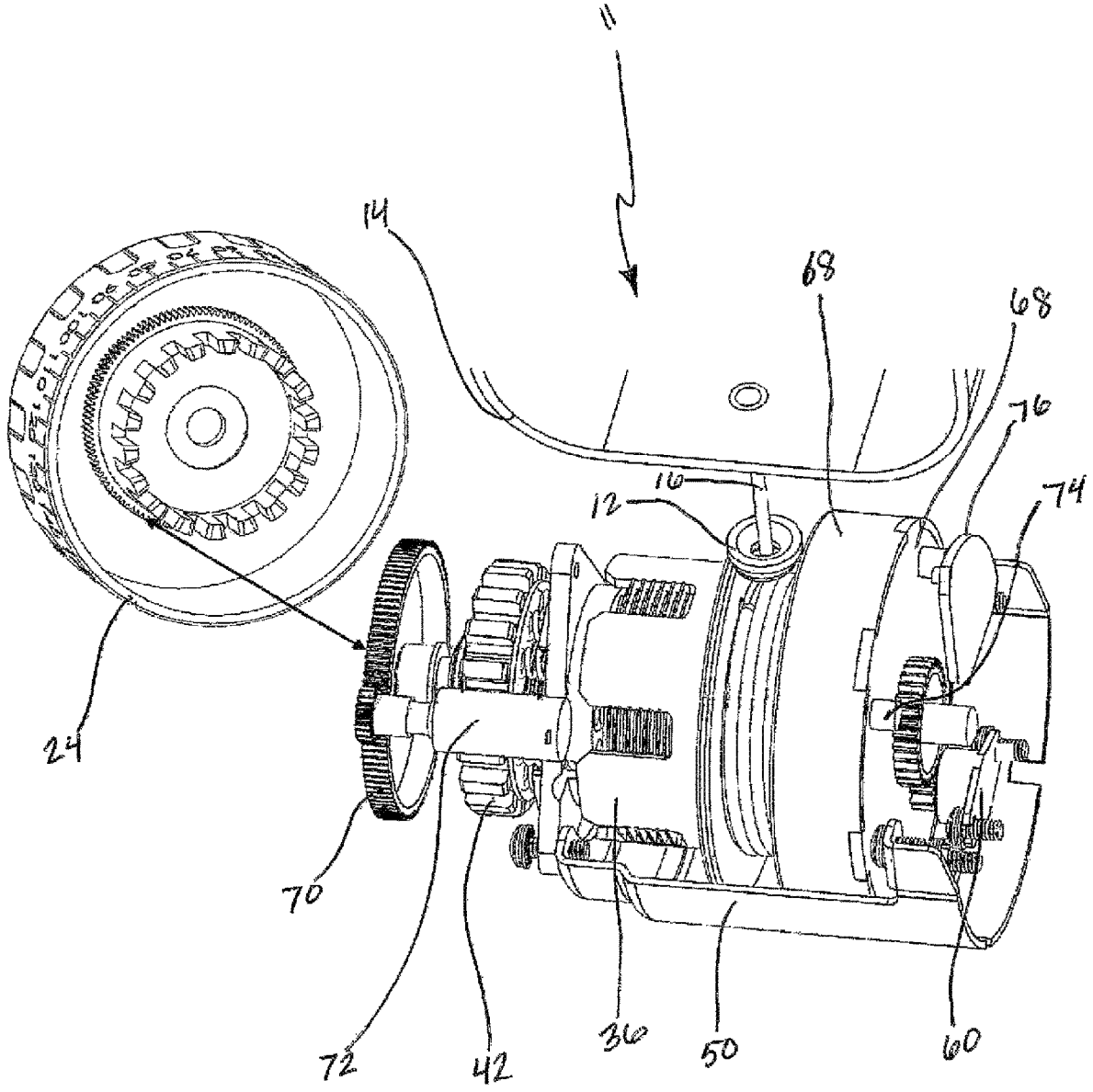
FIG. 7 is another perspective view of the resistance module of FIG. 6.

Looking next to FIG. 7, resistance module 11 shows yet another cutaway view of the slip clutch assembly is shown exposing the resistance cord 16 and resistance cord escape bushing 12 within inner support frame 50. Resistance cord 16 is attached to handle 14 so that when handle 14 is extended, resistance cord 16 is pulled off of the spool. Slip clutch plate driver 36 applies pressure to provide resistance when handle 14 is extended. Threaded spring pressure collar 42 is in communication with resistance adjustment knob 24 which in turn engages with resistance adjustment knob inner gear portion 70, which in turn engages with rotating electromechanical position sensor 72 in order to provide a method of resistance adjustment. At the proximal end is cord rewind speed control dampener 60 for controlling rewind spring. As can be seen from this diagram, cord storage spool 68 contains resistance cord 16. Magnets 74 is in communication with cord spool direction/speed sensor 76.

With combined reference to the aspects shown in FIGS. 8A, 8B, and 8C, a resistance module may be utilized without a platform base plate, and may rather be mounted onto a chair. In essence, the chair will act as a base plate. Handle 14 is in position for a user of the current device to extend outwardly from the chair to affect a proper resistance exercise for the arms of the user. Handle 14 is once again attached to resistance cord 16 emanating from barrel 26 and adjusted for a desired resistance by resistance adjustment knob 24. These various views provide a better understanding of the different angles that handle 14 can be used to effect exercise on different muscles of the arms of a user. For example, FIG. 8A shows the handle 14 coming straight up to exercise biceps, while FIG. 8B shows a beginning for triceps and/or bicep exercise. In FIG. 8C, barrel 26 has been rotated so that handle 14 may be extended laterally for triceps exercise. It shall be noted that barrel 26 is infinitely rotatable so that any desired muscle can be exercised.

FIG. 9 shows the basic resistance module with handle 14, resistance cord 16, rotatable barrel 26, resistance adjustment knob 24 and further includes a mounting bracket 25.

Figure 10:
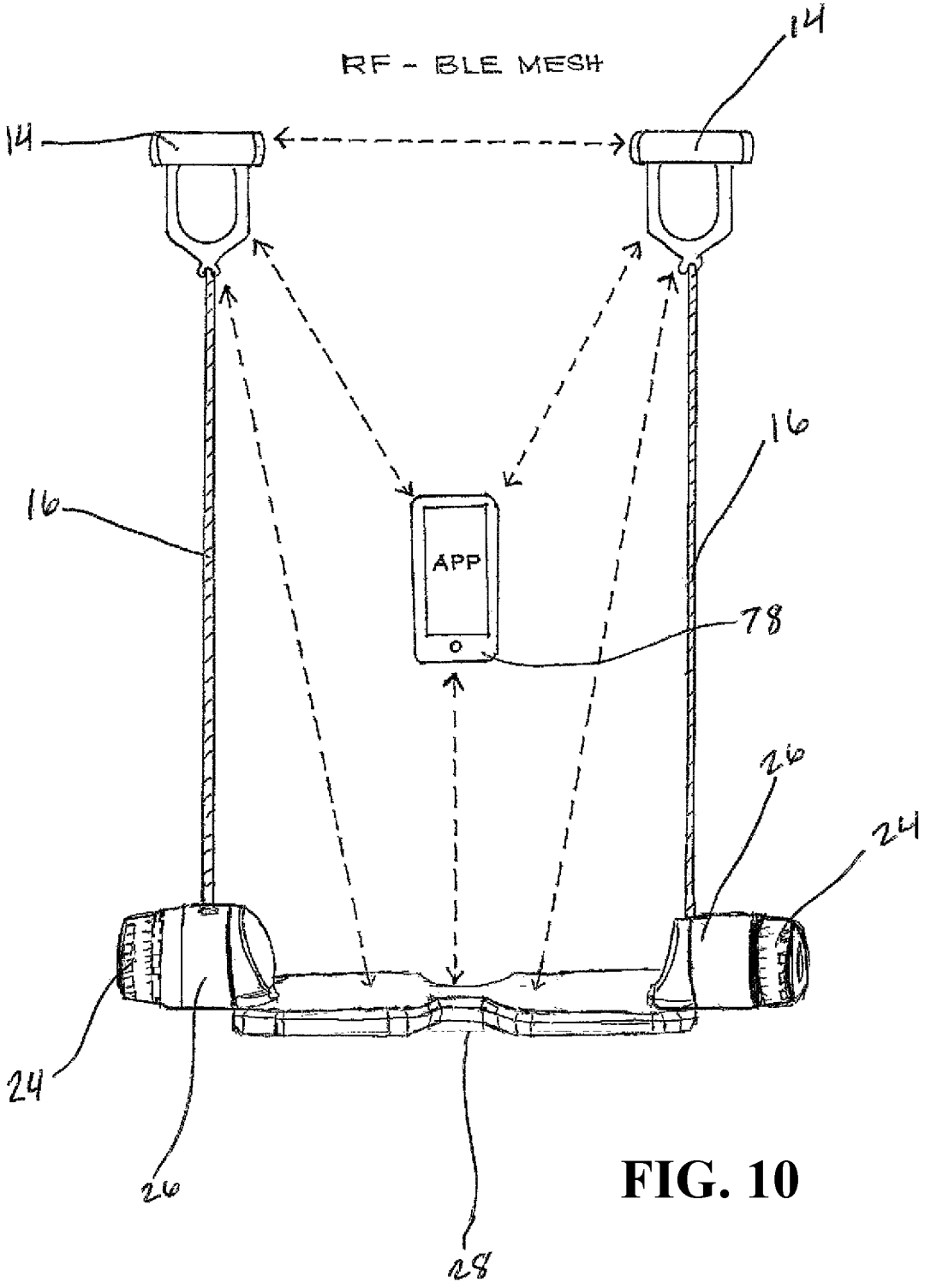
FIG. 10 is a diagram of a RF-Bluetooth® (BLE) Mesh.

FIG. 10 diagrammatically represents the interplay between a smart phone app 78 and the compact high resistance fitness device 10 of the present invention. In this aspect of the invention, a smart phone having the smart phone app 78 for sensing acceleration, orientation and rotation of a modified smart handle 88 corresponding to handle 14 described above is used to track said orientation and rotation movements. The smart phone app 78 receives device settings from both the slip clutch assemblies shown in FIGS. 5-7, and the movement of pull cord 16, described fully hereinabove. Barrel 26 houses resistance indicator knob 24, which changes the resistance upon command.

Figure 11:
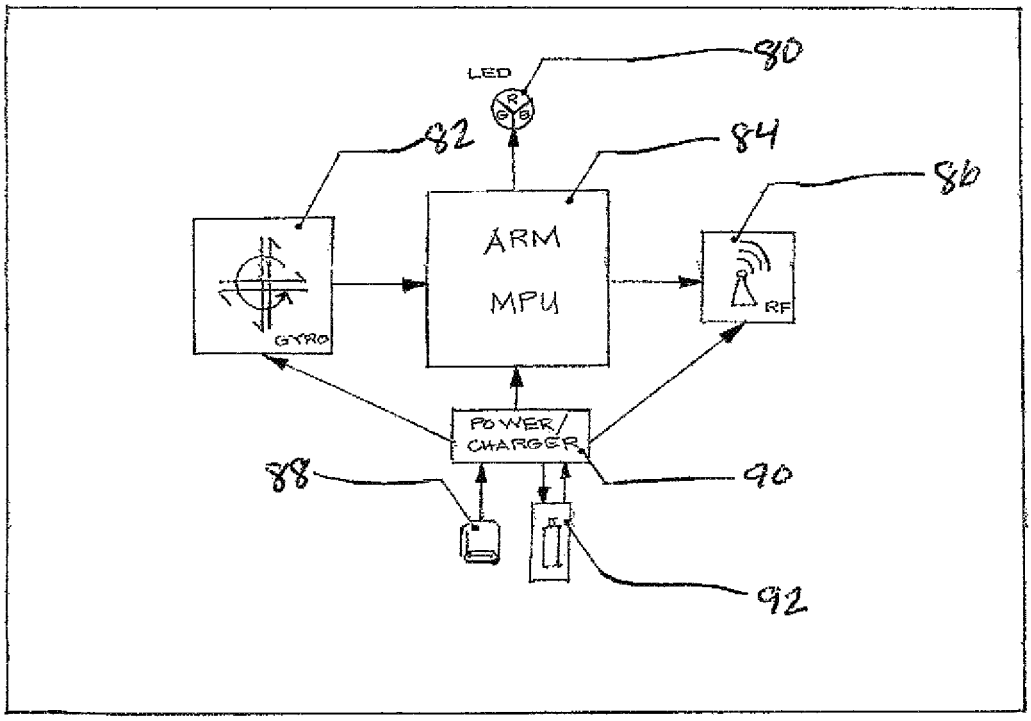
FIG. 11 is a Diagram of a Smart Handle Subsystem.

FIG. 11 is a diagram of the electronics found within the smart handle 88 of FIG. 10. Included in the electronics would be an indicator LED light 80 which is electrically connected to an ARM micro processing unit 84 for storing exercise data from each smart handle 88. A gyro sensor 82 tracks orientation and rotation of smart handle 88 by the use of a gyrometer and accelerometer. A USB power input is used for battery charging within power charger module 90 and rechargeable battery 92. USB power input would be disconnected after charging, but before use. Further in communication with micro processing unit 84 is RF module 86.

Figure 12:
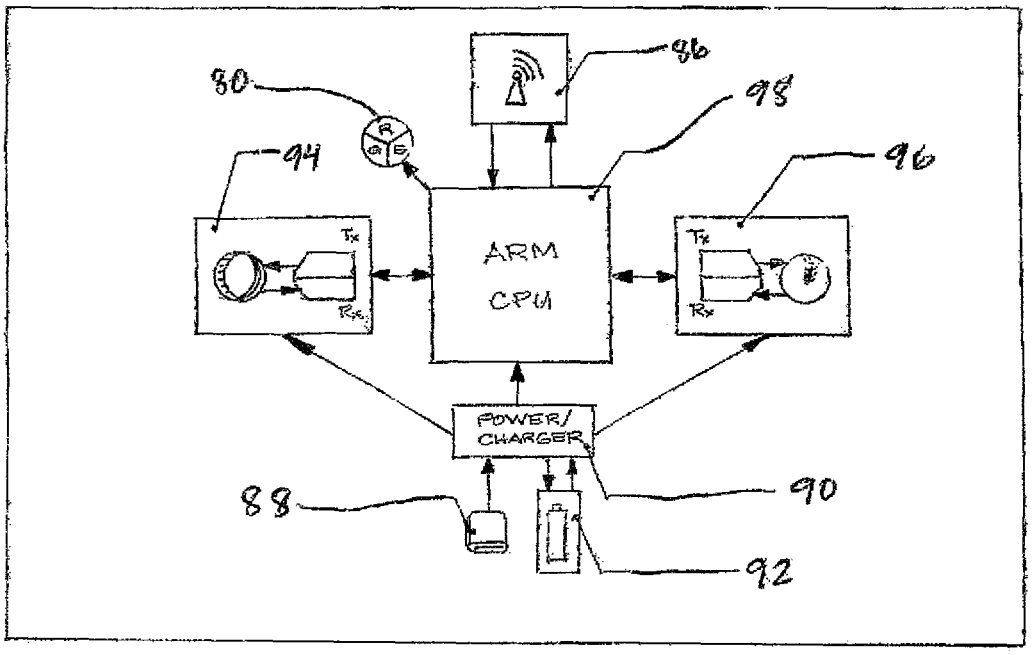
FIG. 12 is a diagram of a first aspect of a Clutch Subsystem.

FIG. 12 is a diagram showing the electronics connections within a clutch subsystem of a slip clutch assembly describe fully hereinabove with reference to FIGS. 5-7. Smart handle 88 is in electrical communication with microprocessing unit 98. A power charging port 90 may be used to recharge batteries used for powering the microprocessing unit 98. Optionlly, a battery 92 may be plugged into the port. This clutch subsystem is similar to the smart handle subsystem of FIG. 11, but further comprises an adjuster 94 and a drum 96 in electronic communication with ARM central processing unit 98. Adjuster 94 includes an adjuster dial having a linear strip of print attached inside of it, from which an included infrared sensor detects a resistance setting, and sends this data to ARM central processing unit 98. Furthermore, drum 96 includes a graduated disc, with markings printed in gray scale, from which an infrared sensor detects the resistance setting selected on adjuster 94. Drum 96 sends this data from the markings to the ARM central processing unit 98 for processing, and then that data is sent to smart phone app (shown in FIG. 10) for calculation of exercise data. RF module 86 utilizes micro processing unit 98 and transmits exercise data to, and receives device settings from, both smart handles 88 and the smart phone app through RF Bluetooth® signals. A red. green, blue (RGB) LED 80 is an indicator of clutch system status.

Figure 13:
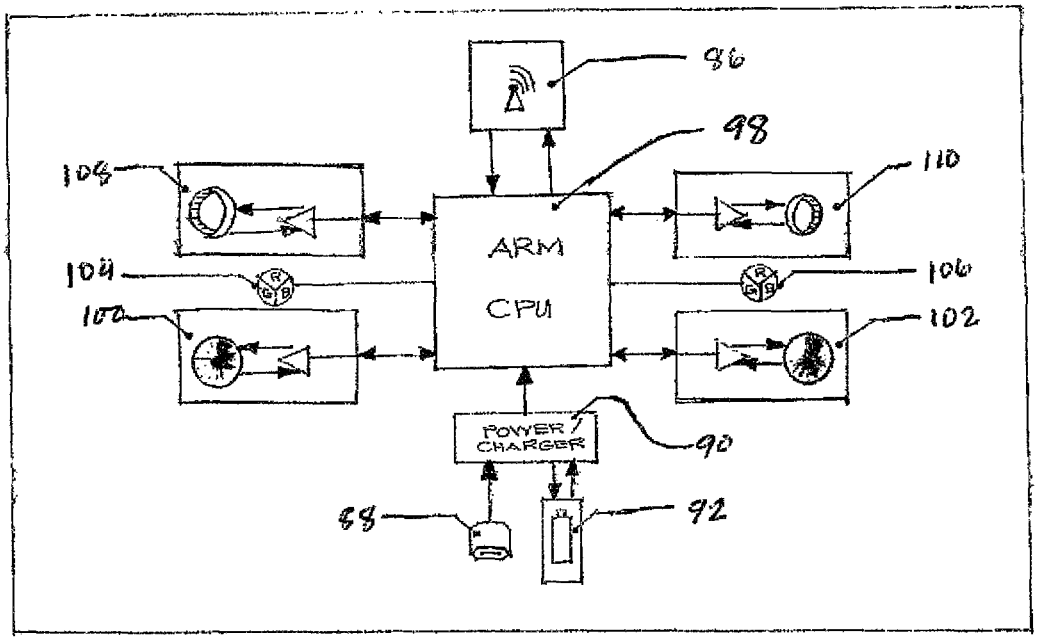
FIG. 13 is a diagram of a second aspect of a Clutch Subsystem.

FIG. 13 illustrates an electronic circuit diagram for yet another aspect of the present invention for use with a system on chip (SoC), rather than a micro processing unit or a central processing unit. In this aspect, there is a left adjuster 108, including an adjuster dial with a linear strip of print attached inside from which an IR sensor detects resistance settings and sending the data about those resistance settings to ARM central processing unit 98. Left drum 100 has a graduated disc, again with markings printed in gray scale, from which an IR sensor detects resistance settings selected on the left adjuster 108 and sends data ARM CPU 98 for processing. From there, data is sent to the smart phone app for calculation of exercise data. Next, we look at right adjuster 110 which also has an adjuster dial with markings of a linear strip of print attached inside, from which an IR sensor detects settings and sends data about those resistance settings to ARM central processing unit 98. As is seen on the left side, right drum 102 also has a graduated disc, with markings printed in gray scale, from which an IR sensor detects resistance settings selected on the left adjuster 108 and sends data ARM CPU 98 for processing. From there, data is sent to the smart phone app for calculation of exercise data. Similar to the above electronic diagrams, an RF module 86 transmits exercise data and receives device settings from both smart handles 88 and smart phone app through RF Bluetooth® signals. In this aspect, there is included a left RGB LED 104 which indicates left clutch subsystem status, in addition to a right RGB LED 106. Also included is a power charger 90 in communication with a USB port import and smart handle 88 as well as rechargeable battery 92 for charging the unit.

Figure 14:
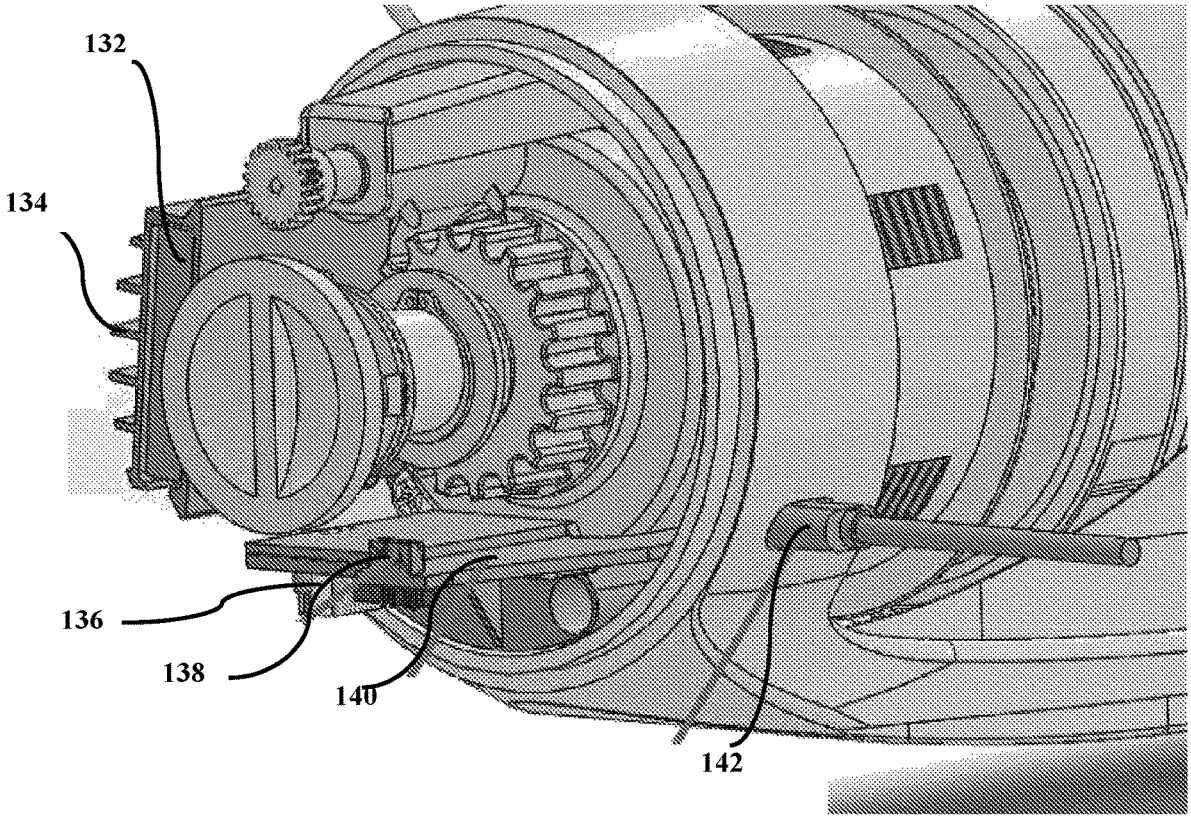
FIG. 14 is a perspective view of a resistance module.

FIG. 14 is a perspective view of the inner workings of a resistance module made in accordance with the present invention that illustrates the relative placement of battery 132 and heat sink 134. Battery connector 136 is in electrical communication with sensor 138 and printed circuit board 140, which is also in electrical communication with microUSB cable 142. The battery system configuration powers the electronic portions of the invention.

Figure 15:
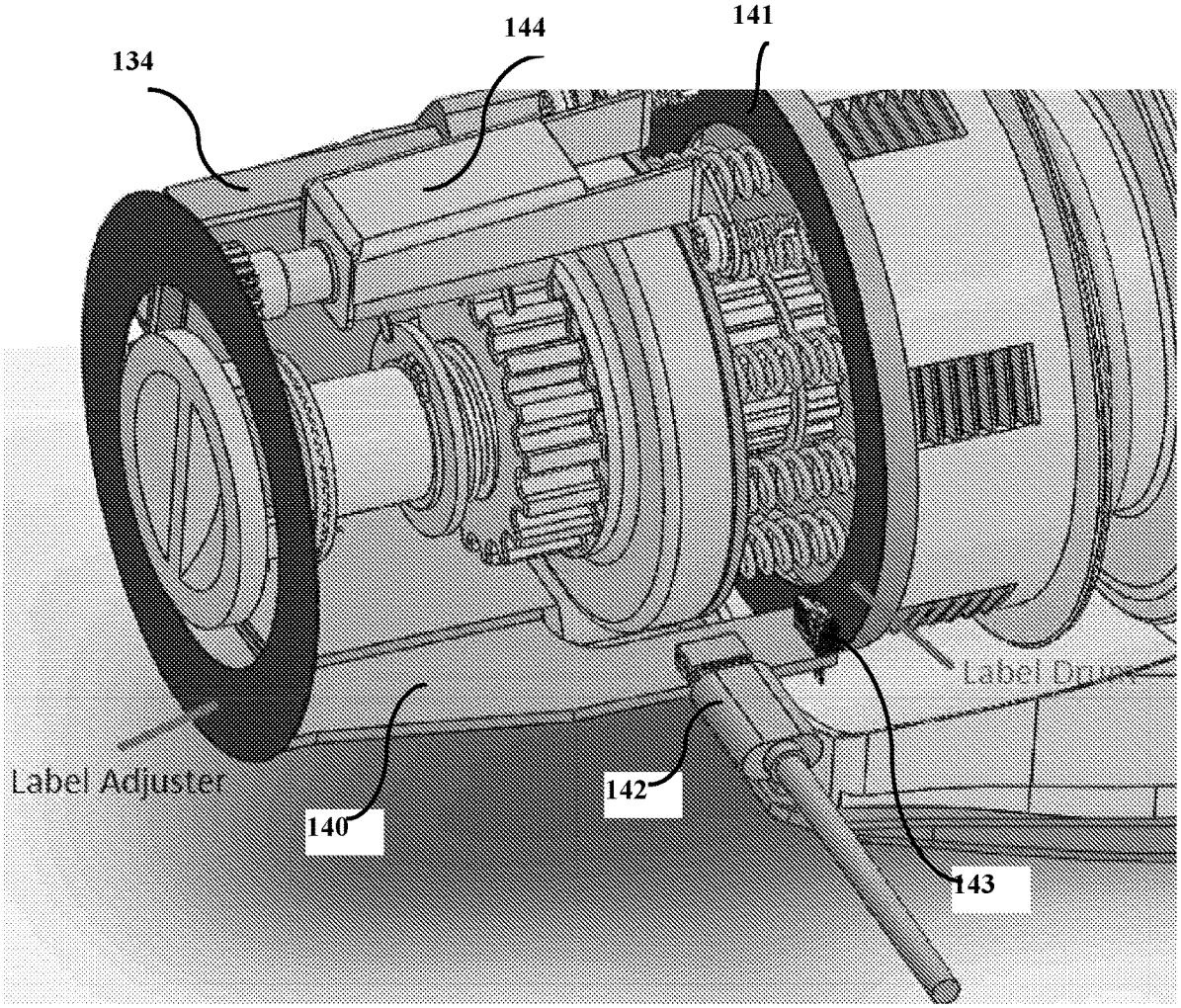
FIG. 15 is another view of FIG. 14.

Looking next to FIG. 15, another view of the resistance module of FIG. 14 is shown, where a potentiometer 144 acts as an adjustment in communication with a gear below. Label drum 141 includes markings that are read by diode 143. The markings are on a sticker on label drum 141.

Figure 16:
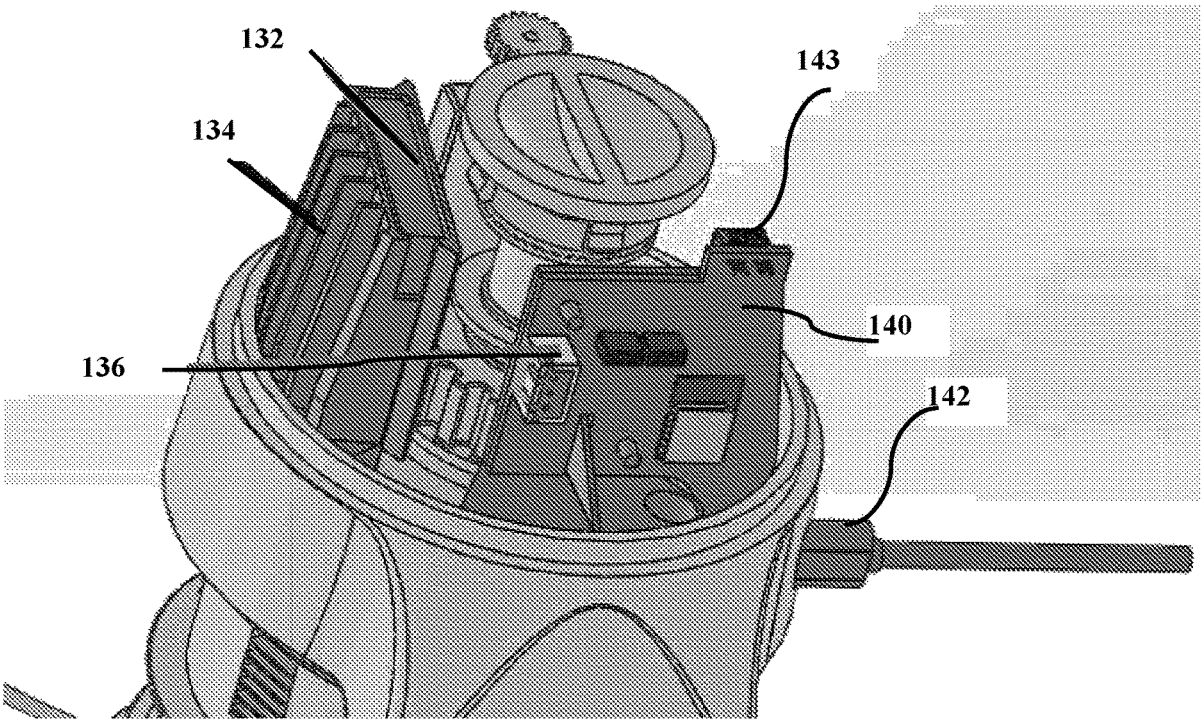
FIG. 16 is a perspective view of the battery.

FIG. 16 is another view of the resistance module of FIG. 14, showing the relative placement of battery 132, heat sink 134 and battery connector 136 on printed circuit board 140. Again, micro USB cable 142 is in electrical communication with printed circuit board 140. Diode 143 is positioned on printed circuit board 140 to read the markings on label drum 141 (not shown here).

Figure 17:
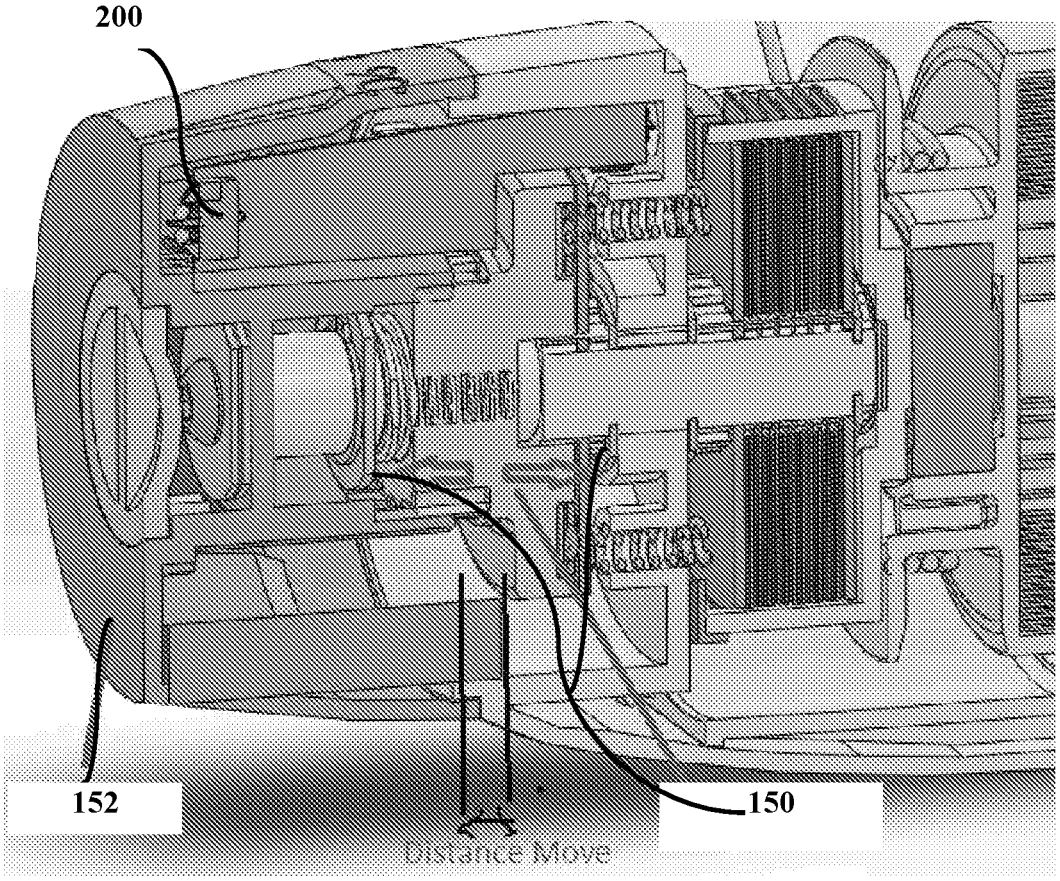
FIG. 17 is a side elevational cutaway view of the module.

FIG. 17 is a cutaway view of the resistance module, detailing the movement of nut spring 150 responding to a position change regulated by dialing adjuster 152. Diode 200 reads markings, collecting data on the desired data being collected, such as motion of cycles, etc.

FIG. 18 shows a close-up of diode 200 reading markings on label drum 141 in relative placement to the slip clutch plate driver 36 and the stack of stationary friction plates 38A and rotatable friction plates 38B that are engaged with the friction pads 38C therebetween. Diode 200 reads the motion of cycles, calories burned, and other pertinent information from the label drum shown in previous figures.

Figure 19A:
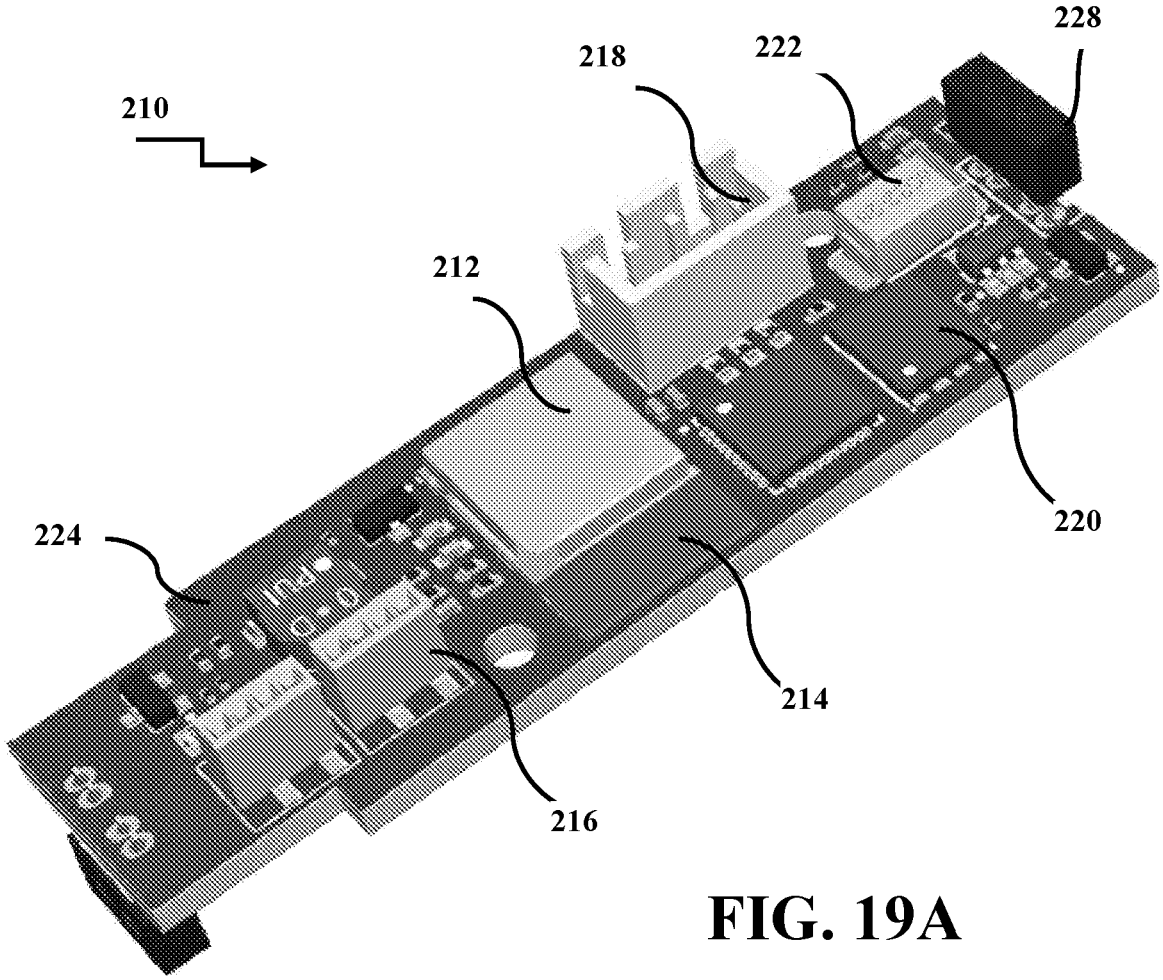
FIG. 19A is a top perspective view of the circuit board.

FIG. 19A is a top perspective view of printed circuit board 210 including Bluetooth® (BLE) Module 212, Bluetooth® (BLE) antenna 214 and a PGM connector 216 for connecting the Compact high resistance fitness device wirelessly to a data collector, such as a smartphone. In one of the aspects of the present invention, data is collected from sensors on board the compact high resistance fitness device and that data is relayed by Bluetooth® (BLE) module 212 to a smartphone (not shown here). Battery connector 218 provides power from the battery to the circuit board 210, while regulator 220 and capacitor 222 regulate the power to printed circuit board (PCB) 224. As infrared (IR) sensor 228 reads the aforementioned gray scale sticker on either end of the drum 96 of FIG. 12, the infrared sensor detects the resistance setting selected on adjuster 94 of FIG. 12 and sends this data from the markings to the ARM central processing unit 98, also of FIG. 12, for processing. That data is then sent to a processor, such as a smart phone app (shown in FIG. 10) for calculation of exercise data.

Figure 19B:
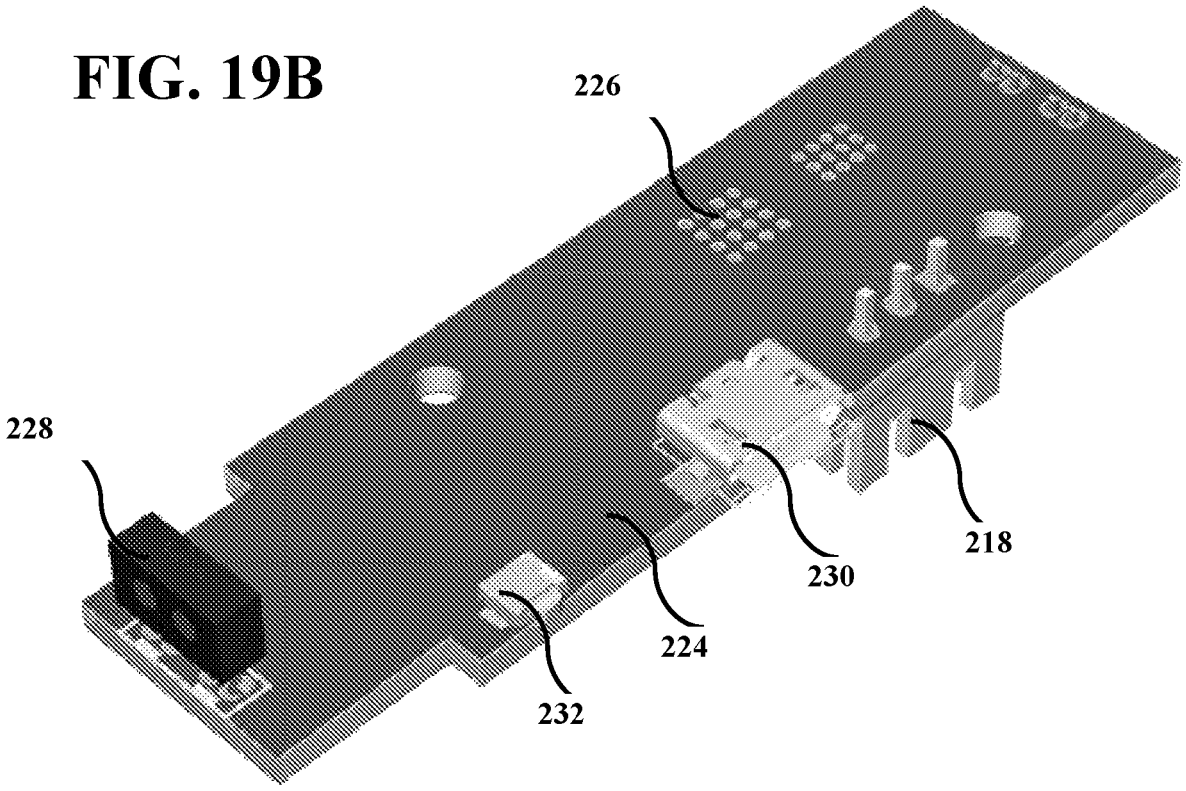
FIG. 19B is a bottom perspective view of the circuit board.

With combined reference to FIGS. 19A and 19B there is shown a bottom perspective view of the printed circuit board 210 of FIG. 19A, including printed circuit board (PCB) 224, and wherein infrared (IR) sensor 228 extends outwardly from printed circuit board (PCB) 224. Solder plated holes 226 for both the capacitor 222 and regulator 220 connect USB connector 232 and capacitor 222, which are used to regulate the charging of the battery from an external AC power source by battery connector 218.

Figure 20:
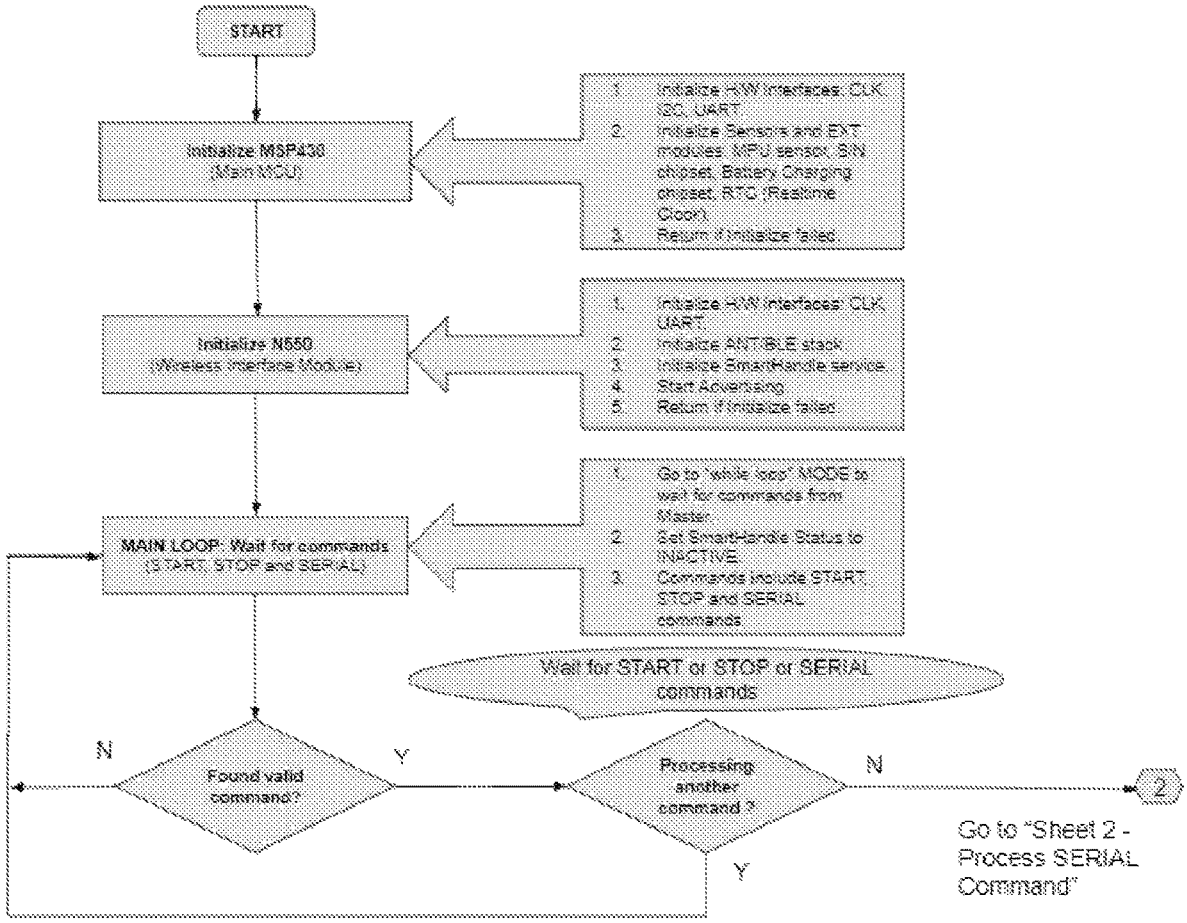
FIG. 20 is a diagram of a Smart Handle Flow Chart displaying the Initialization and Main Loop.
Figure 21:
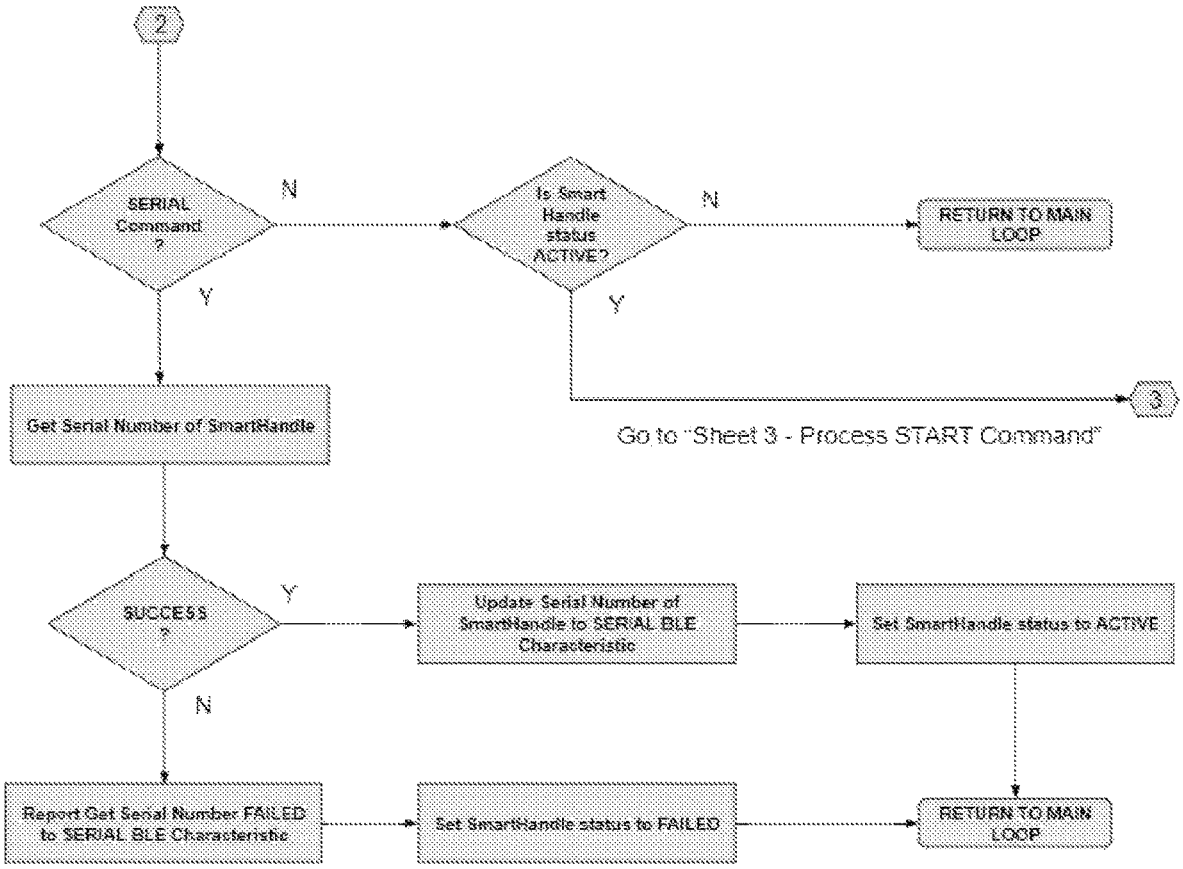
FIG. 21 is a diagram of a Smart Handle Flow Chart displaying the Process Serial Command.

FIG. 20 provides a flowchart of the initialization and the main loop of the data initiated by the smart handle described hereinabove, while FIG. 21 is a flowchart of the process serial command to practice the present invention.

Figure 22:
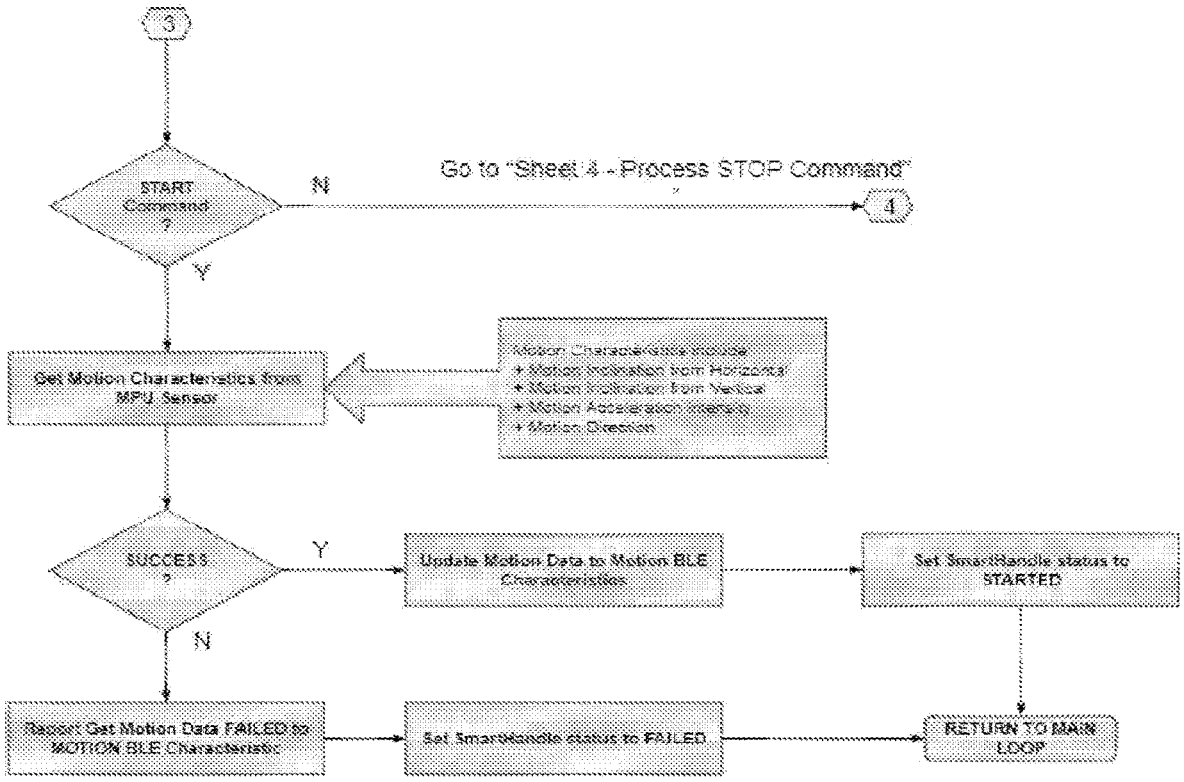
FIG. 22 is a diagram of a Smart Handle Flow Chart displaying the Process Start Command.
Figure 23:
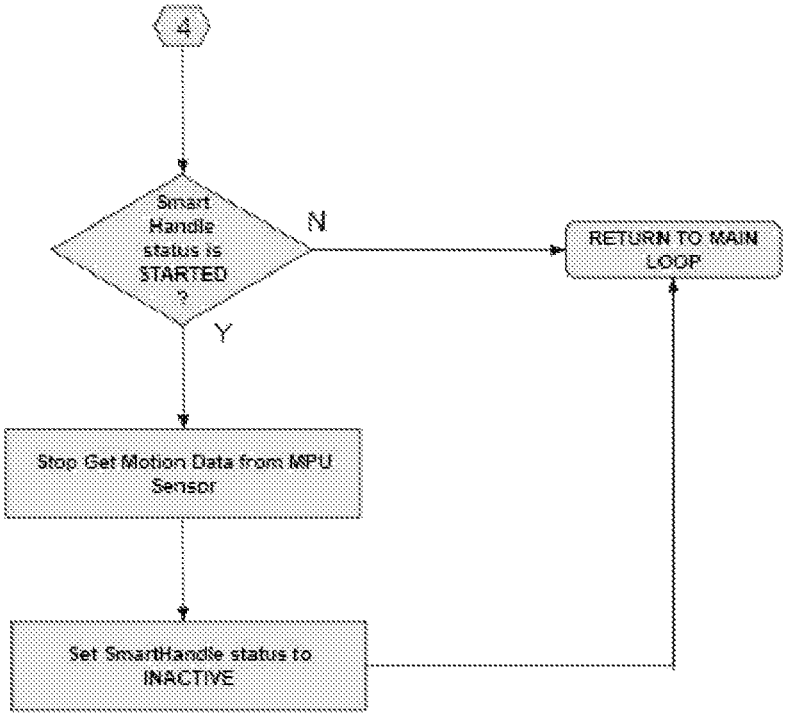
FIG. 23 is a diagram of a Smart Handle Flow Chart displaying the Process Stop Command.

FIG. 22 is a flowchart of the process "start" command for the smart handle to practice the present invention, while FIG. 23 is a flowchart of the process "stop" command to practice the present invention.

Figure 24:
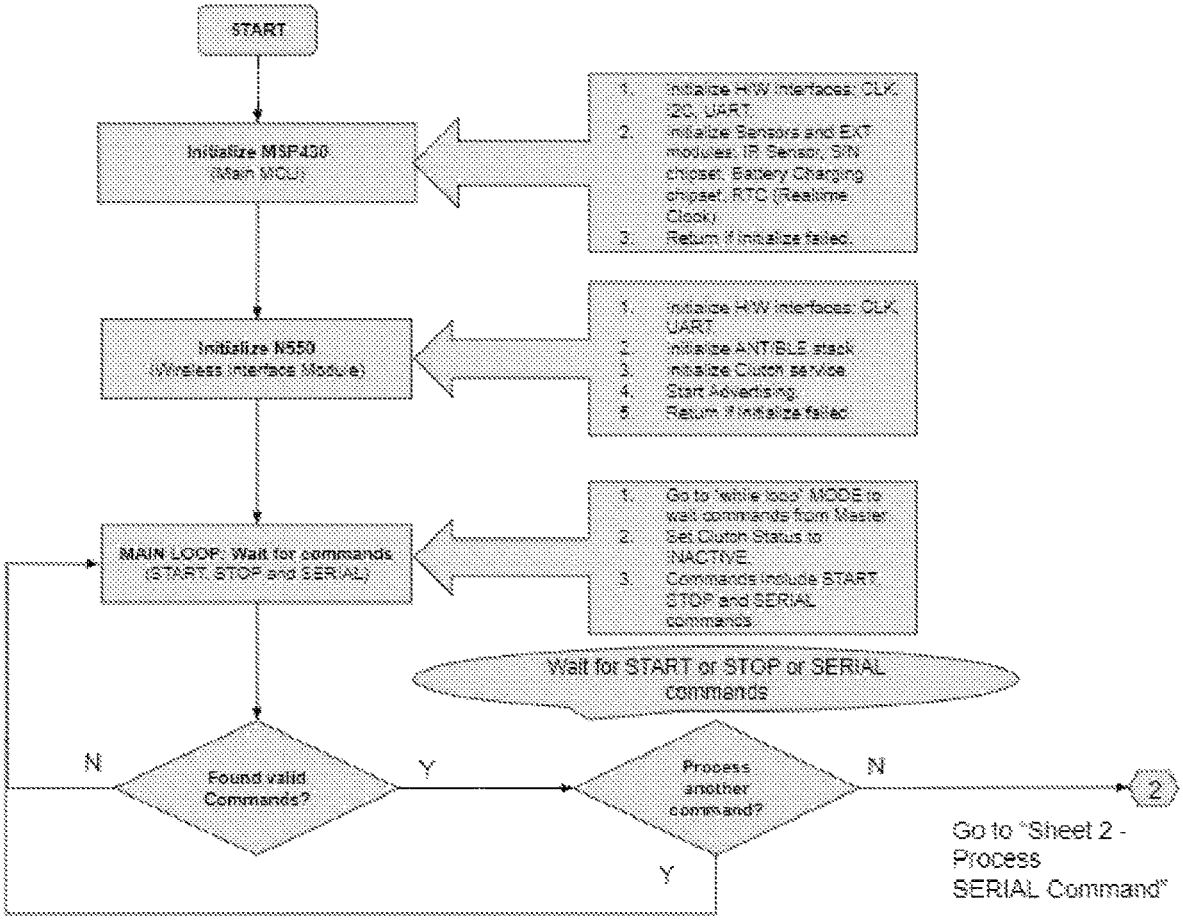
FIG. 24 is a diagram of a Clutch Flow Chart displaying the Initialization and Main Loop.
Figure 25:
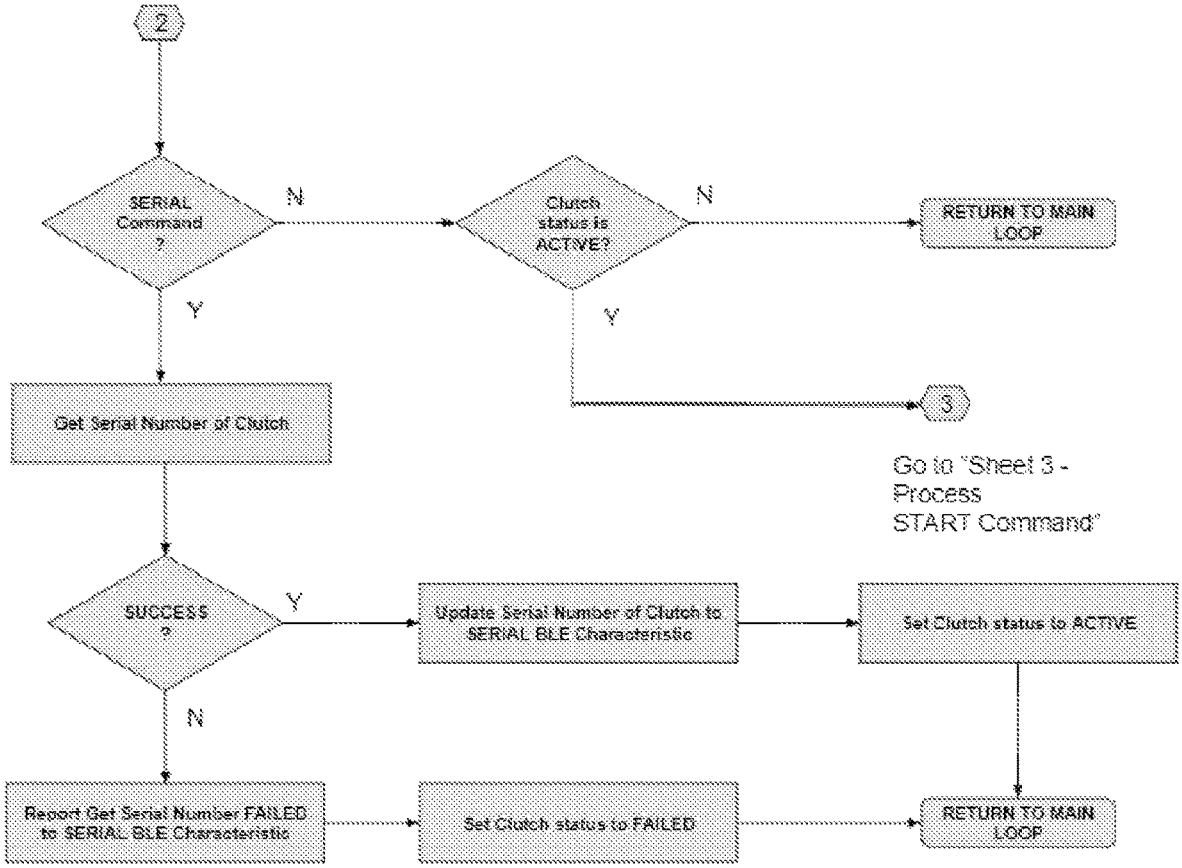
FIG. 25 is a diagram of a Clutch Flow Chart displaying the Process Serial Command.

FIG. 24 is a clutch flowchart of the hardware initialization and main loop processes used to practice the present invention, and FIG. 25 is a flowchart of the clutch process serial command to practice the present invention.

Figure 26:
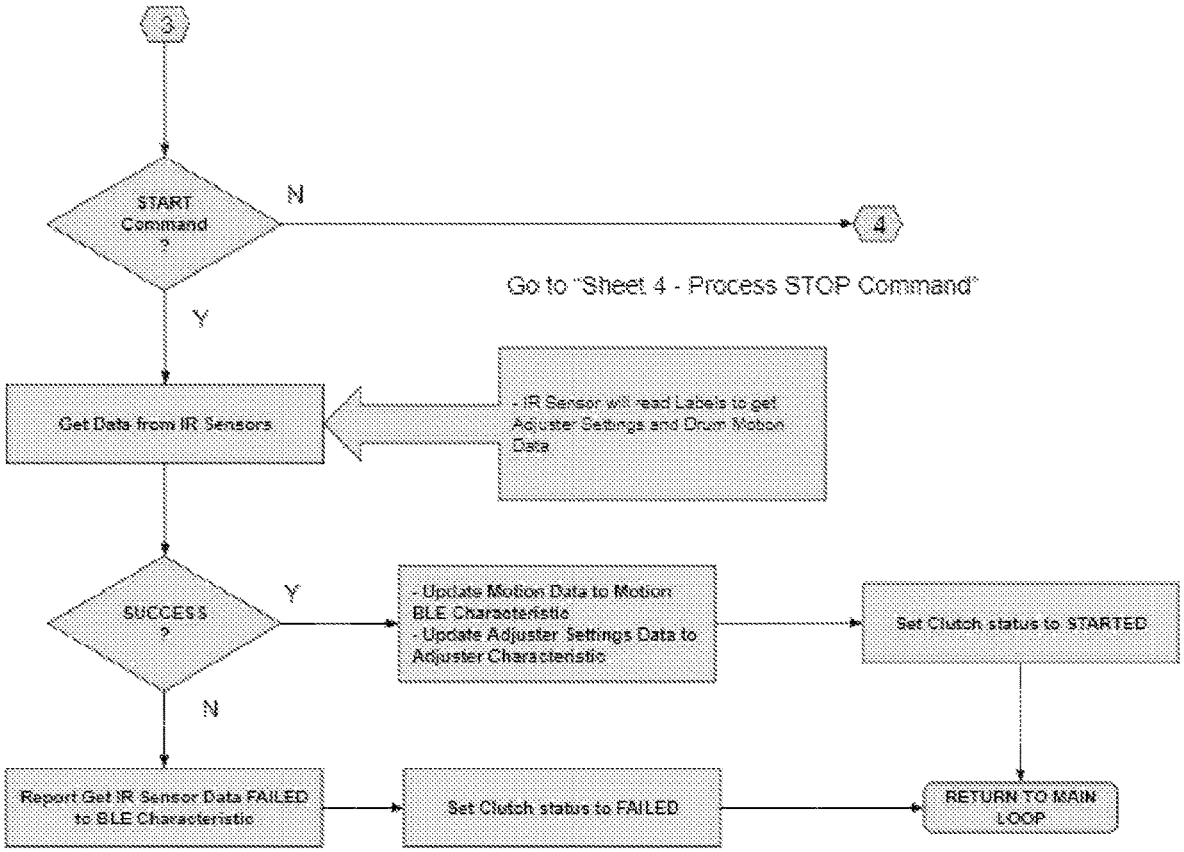
FIG. 26 is a diagram of a Clutch Flow Chart displaying the Process Start Command.
Figure 27:
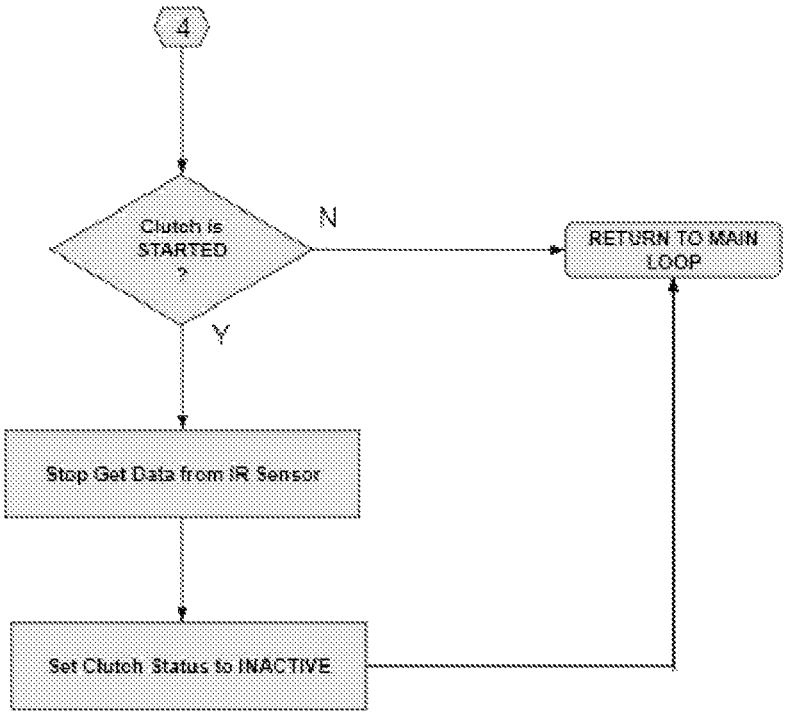
FIG. 27 is a diagram of a Clutch Flow Chart displaying the Process Stop Command.

Again, FIG. 26 is a flowchart of the clutch process "start" command to practice the present invention, while FIG. 27 is a flowchart of the clutch process "stop" command.

Figure 28:
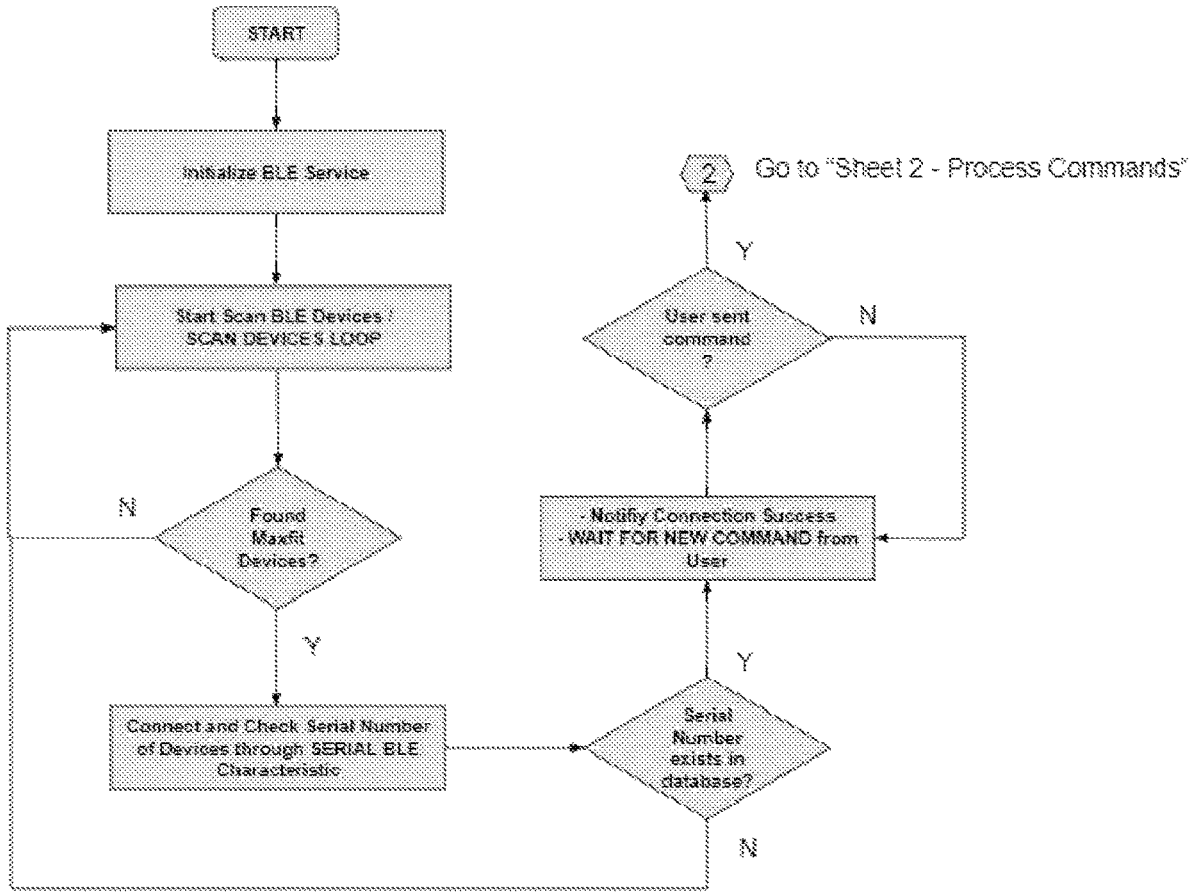
FIG. 28 is a diagram of an Android/IOS Application Flow Chart displaying the Start Up and Scan Devices Loop.
Figure 29:
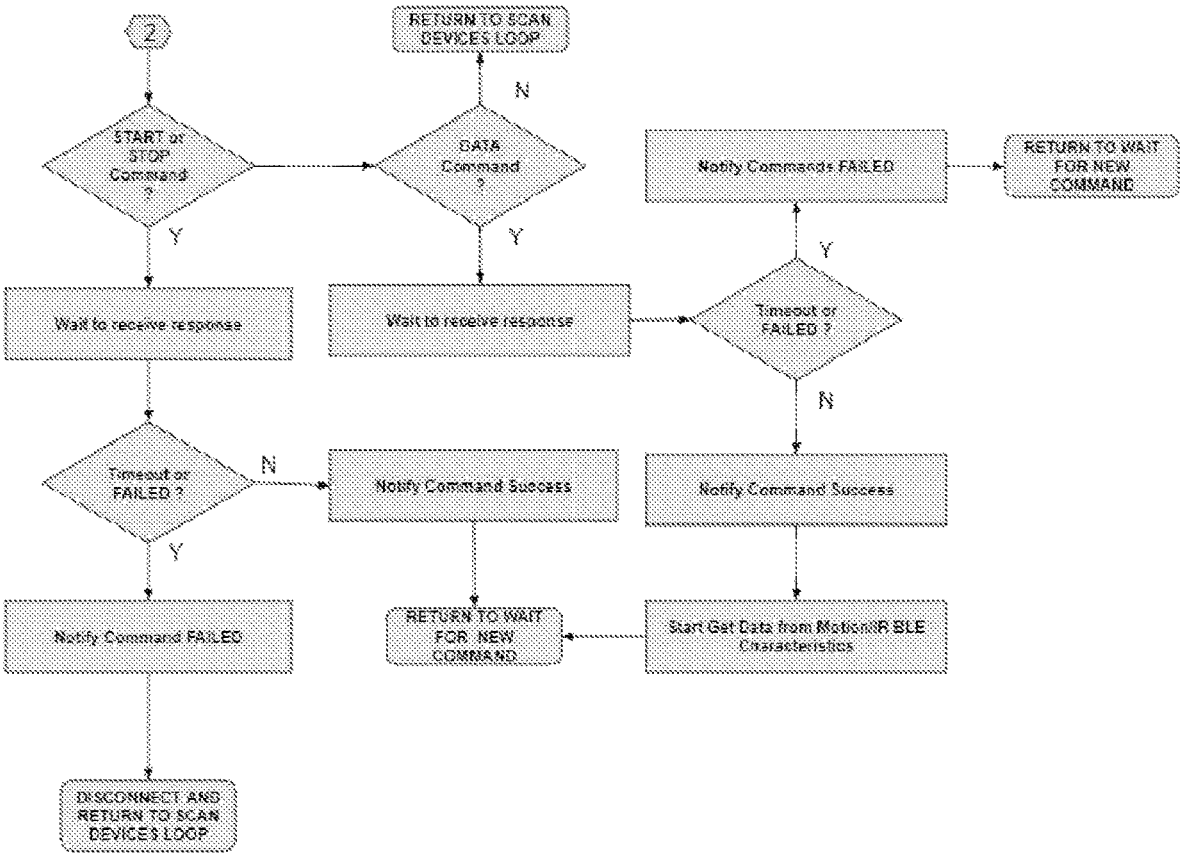
FIG. 29 is a diagram of an Android/IOS Application Flow Chart displaying the Process Commands.

FIG. 28 is a smart phone app flowchart of the Android/IOS application start up and scan devices loop command, and FIG. 29 is a flowchart of the Android/IOS application process commands.

Looking lastly to FIG. 30, the electronic circuitry for the transfer of data from the present invention exercise machine consists of the following functional blocks. As can be imagined, there would be a functional block for each of the smarthandles 512 in the invention. For example, there would be two smarthandles 512 for each unit, one on each side. In that regard, this FIG. 30 shows the circuitry for one of the sides, wherein a DC Power circuit 500 on the exercise machine's base unit provides electric power to both a motor drive circuit 502 and an encoder circuit 504. The DC Power Circuit 500 includes a rechargeable battery 506 that can be charged from any AC electrical source by a USB charging cable (not shown here). Each Motor Drive Circuit 500 on the base unit controls the movement of each brushless DC/BLDC Motor 510. The two BLDC Motors 510, which are to be located on each side of the base unit act as the force-producing elements of the equipment and provide resistance during exercise movements. Each BLDC Motor 510 has a stator with a very high pole count of symmetrical stator windings, with integrated Hall and IR sensor printed circuit boards for rotational feedback. The stator windings will be controlled by an external dedicated electronic control module. The sensors feed data back to the electronic control module which determines the amount of current required for the stator to maintain the torque profile set by the user's program. The preferred BLDC will include a large number of windings in communication with a rotor and output shaft coupled to a pulley for exerting torque and thus tension to an attached rope which provide resistance to a user applied effort. The rope terminates at the smarthandles 512 for sensing data.

Still referring to FIG. 30, adjuster knob 514 located on the base unit is the first of two user interfaces to manually adjust maximum controlled current to the encoder circuit module 504 to vary resistance throughout exercise movements. Alternatively, a smartphone app 516 is the second possible user interface capable of remotely controlling the encoder circuit 504. Through smartphone app 516, the user inputs resistance settings and profiles that are sent wirelessly to a Bluetooth® low energy module 518. The profile settings, workout progress and device sensors are continuously displayed to the user on the smartphone app. The Bluetooth® low energy module on the base unit provides wireless connectivity between the smartphone app 516 and the encoder circuit 504. The encoder circuit 504 on the base unit may contain at least one infrared sensor capable of reading the user-selected maximum resistance setting to control the BLDC motors' torque.

The preferred aspect of the present invention includes a pulley system 520 on either side of the exercise machine base unit acting as mechanical linkages that transfer power between the BLDC motor output shafts and rope 522, converting rotational motion to linear motion. Each rope 522 extends from each pulley system 520 to each smarthandle 512, transmitting tension force around the pulley system 520.

In operation, the two smarthandles 512 are pulled by the user during exercise movements. Factory calibrated smarthandles 512 also collect exercise and various sensor data through a Bluetooth® module built into each handle. The data is then sent to the smartphone app 516 to be analyzed and displayed.

Again, in carrying out this aspect of the method of operation in accordance with the present invention, the basic premise of operation is that the BLDC motor shall act as a brake, providing resistance to the user throughout the user's exercise movements using this machine. The user exerts load on the motor shaft use of the Smart Handle and Rope assembly. When the user pulls the rope 522, the pulley system 520 rotates, causing the motor shaft to rotate. The encoder circuit 504 senses the position of the motor shaft and signals the drive circuit 500 to control the motor current and magnetic field to the appropriate position, maintaining the proper torque setting selected by the user.

In a conventional BLDC motor, the output shaft or rotating component is called the rotor, whilst the coil windings are stationary and are called the stator. In this aspect, options for the use of a BLOC motor are for the rotor to be internal or external (out-runner) type.

BLOC motors generally have a low pole count, where the pole is defined as a single magnetic field, for smooth high speed rotation. In contrast to BLDC, stepper motors have a high pole count for low speed high torque. The present invention may preferably have a very controllable HIGH torque, with smooth operation during high stall current operation.

A BLOC motor has a directly proportional linear relationship between torque on the output shaft or rotor and the current applied to the coil windings or stator. i.e Torque=(M+Mr) 1 Km I=Current (amps);

Km=Torque constant (metric units: mNm/A);

M=Torque(demand)

Mr=(Starting Friction [static+dynamic]) (Dynamic friction In metric units: mNm/rpm)

The voltage applied to the stator of the DC motor is proportional to the rotational speed of the rotor.

Back-EMF constant KE from the torque constant KM:

$$=KM*(2x/GO)$$

Subtract the product of the current Land terminal resistance P from the applied voltage Q~ and multiply that quantity by 1,000 over the back-EMF constant to obtain the approximate speed n of the motor at the operating point (speed at torque):

$$n=(U-I*R)*(1{,}000/KE)$$

Thus, the rotational speed and the resistance of the rope pull force may be calculated, the data registered, and the motor rotational position sensing is then determined, selecting the current required to maintain the torque profile which can be set by the user and the relevant program.

The foregoing description of various preferred aspects of the invention has been presented for purposes of illustration and description. It is not intended to be exhaustive or to limit the invention to the precise form disclosed. Obvious modifications or variations are possible in light of the above teachings with regards to the specific aspects. The aspects were chosen and described in order to best illustrate the principles of the invention and its practical applications to thereby enable one of ordinary skill in the art to best utilize the invention in various aspects and with various modifications as are suited to the particular use contemplated. It is intended that the scope of the invention be defined by the claims which are appended hereto.

INDUSTRIAL APPLICABILITY

The present invention finds industrial applicability in exercise equipment, fitness devices as well as in medical rehabilitation devices for providing full functioning after injury.

What is claimed is:

1. A compact high resistance fitness device, comprising:

a platform base plate having opposing ends;

at least one resistance module mounted to the platform base plate on a respective one of the opposing ends of the platform base plate wherein each of said opposing ends has a respective one said resistance module thereon, said at least one resistance module having opposite first and second module ends and including a frame structure on said first module end, an axle shaft being rigidly mounted to said frame structure and extending toward said second module end to define a shaft axis extending axially in a direction between said first and second ends of said resistance module;

each of the at least one resistance modules having independent user-selectable resistance settings so that an incremental resistance force is settable within an incremental resistance force range;

each said resistance module including a pull cord coil storage spool rotatable about said axle shaft for unwinding and winding and configured to wrap and unwrap a high-strength pull cord, said high-strength pull cord emanating from the resistance module, and said high-strength pull cord terminating at its outer end by a hand/foot receptacle with a length, which allows unwinding of the pull cord through pull cord strokes extending a variable distance;

a user adjustable resistance force adjustment knob supported on said axle shaft on said second module end for adjusting said incremental resistance force;

a variable resistance rotary slip-clutch engaged with said adjustment knob and disposed axially between said adjustment knob and said pull cord coil storage spool for setting said incremental resistance force which resists rotation of said pull cord coil storage spool during unwinding of the high-strength pull cord, said variable resistance rotary slip-clutch having a stack of a plurality of stationary friction plates and a plurality of rotatable friction plates that are engaged with friction pads therebetween wherein one said friction pad is disposed between each adjacent pair of one said stationary friction plate and one said rotatable friction plate;

a one-way clutch bearing mounted to said axle shaft axially between said variable resistance rotatable slip-clutch and said frame structure and engaged with said pull cord coil storage spool and said variable resistance rotary slip-clutch, wherein unwinding of the high-strength pull cord locks the one-way clutch bearing to generate resistance to rotation of the storage spool by the variable resistance rotatable slip-clutch and winding of the pull-cord unlocks the one-way clutch bearing and releases said resistance to rotation;

a rotatable housing cover provided external to the at least one resistance module and having a cord escape port orifice overlying said pull cord coil storage spool for directing and delivering the high-strength pull cord, said rotatable housing cover being adapted to rotate about the resistance module to move the cord exit orifice angle to minimize cord wear; and said rotatable housing cover being pivotally mounted to said frame structure and wherein an axis of the rotatable outer cover is aligned with the respective axis of said axle shaft, said rotatable housing cover having opposite, axially-adjacent first and second cover end sections disposed axially between said frame structure and said adjustment knob wherein said first cover end section overlies said pull cord coil storage spool and said one-way bearing and said second cover end section overlies said variable resistance rotatable slip-clutch.

2. The compact high resistance fitness device according to claim 1, wherein said compact high resistance fitness device is portable.

3. The compact high resistance fitness device according to claim 1, wherein the resistance module is controlled by a motor for change of resistance during said pull strokes of said cord.

4. The compact high resistance fitness device according to claim 3, wherein the motor is programmable.

5. The compact high resistance fitness device according to claim 1, wherein the resistance module location is positionable in up, middle, and down positions and positioned in one of said up, middle, and down positions during use.

6. The compact high resistance fitness device according to claim 1, wherein the at least one resistance module is self-winding.

7. The compact high resistance fitness device according to claim 1, wherein the at least one resistance module further includes sensors.

8. The compact high resistance fitness device according to claim 1, wherein the at least one resistance module further includes an IoT connectivity app to provide data communication through connectivity apps.

9. The compact high resistance fitness device according to claim 1, wherein the at least one resistance module is programmable.

10. The compact high resistance fitness device according to claim 1, wherein the at least one resistance module is voice actuated.

11. The compact high resistance fitness device according to claim 1, further comprises an audio capable speaker for listening to instructions from a coaching app.

12. The compact high resistance fitness device according to claim 1, wherein the at least one resistance module further includes a potentiometer for adjusting resistivity.

13. The compact high resistance fitness device according to claim 1, wherein the at least one resistance module includes Hall sensors.

14. The compact high resistance fitness device according to claim 1, wherein the at least one resistance module includes electronic controls.

15. The compact high resistance fitness device according to claim 1, wherein the at least one resistance module includes at least one wireless transmission and receiver.

16. The compact high resistance fitness device according to claim 1, wherein the hand/foot receptacle includes a smart handle with sensors embedded therein for relaying medical data.

17. The compact high resistance fitness device according to claim 1, wherein the at least one resistance module further includes said user-actuated resistance force adjustment knob integral with the housing cover that includes incremental radial position marks that are labeled with a corresponding approximate resistance force value indicator.

18. The compact high resistance fitness device according to claim 1, wherein said at least one resistance module can be moved from a locked in-use position to a locked storage position and wherein said locked storage position reduces the overall length of said fitness device by approximately the combined length of each of the at least one resistance modules, said platform base plate having opposing first and second ends comprised of base plate segments having opposite first and second faces with said second surfaces facing away from said first surfaces, said base plate segments having opposite outer ends that define said first and second ends of said platform base plate which each have one said resistance module mounted thereon, said base plate segments further having adjacent inner ends pivotally joined together so as to be foldable between said locked in-use position with said first surfaces and second surfaces being aligned flat and said locked storage position with said first surfaces facing each other for storage and said second surfaces facing in opposite directions away from said first surfaces.

19. The compact high resistance fitness device according to claim 1, further comprising said rotatable slip clutch in the at least one resistance module includes a plurality of friction plates wherein each adjacent pair of said friction plates are spaced apart by one of a plurality of friction disks, and wherein said plurality of said friction plates comprise rotatable friction plates and stationary friction plates and each of said plurality of friction disks contact one said rotatable friction plate on one side and one said stationary friction plate on the opposite side and further wherein said plurality of friction plates and friction disks are pressed together by a plurality of compression springs to generate a rotation resistance by said rotatable slip clutch which resists pulling of said cord, wherein the rotation resistance of the rotatable slip clutch is varied by reducing the length of the plurality of compression springs and thereby increasing a force of the plurality of compression springs generated on said plurality of friction plates.

20. The compact high resistance fitness device according to claim 1, wherein a length of the platform base plate defines a space for the user's shoulders to fit between said resistance modules in an in-use position.

21. The compact high resistance fitness device according to claim 1, wherein said setting of said incremental resistance force defines a set resistance force, and the at least one resistance module further includes at least one of electronic sensors, circuitry, a computing processing device (CPU) and communication devices that allow said compact high resistance fitness device to record a number and length of said pull cord strokes, along with the set resistance force of each said pull cord stroke, and said at least one of electronic sensors, circuitry, a CPU and communication devices being adapted to compile these values from each of two said resistance modules and transmit this information to a user supplied receiving device that will record and display the information to the user, and wherein each of said two resistance modules communicates wirelessly between the two resistance modules and wherein at least one of the two resistance modules will be designated to communicate wirelessly with the user supplied receiving device.

22. A compact high resistance fitness device adapted for resistance force exercise, comprising:

a platform base plate;

at least one resistance module attached to the platform base plate, said at least one resistance module including a frame structure, and an axle shaft rigidly mounted to said frame structure, a one-way clutch bearing mounted to said axle shaft, a user adjustable resistance force adjustment knob, and a variable resistance rotary slip-clutch having a stack of stationary friction plates and rotatable friction plates that are engaged with friction pads therebetween wherein one said friction pad is disposed between each adjacent pair of one said stationary friction plate and one said rotatable friction plate, said one stationary friction plate and said one rotatable plate of said adjacent pair being engaged in contact with opposite sides of said one friction pad wherein friction is generated between each said friction pad and said one stationary friction plate and said one rotatable plate engaged with said opposite sides thereof to generate friction therebetween to resist rotation of said rotatable friction plates;

said rotatable friction plates being pivotally engaged with said one-way bearing and said stationary friction plates being non-rotationally mounted to said frame structure;

a cord storage spool, a user extendable pull-cord secured around the cord storage spool;

wherein said cord storage spool is pivotally mounted to said axle shaft for rotation about a respective axis of the axle shaft and engaged with said one-way clutch bearing;

a rotatable outer cover over the at least one resistance module, said rotatable outer cover including a pull-cord escape port;

said user extendable pull-cord being terminated at an outer end by a user actuated receptacle and having a length to allow pull-strokes wherein said pull-cord is extendable out of said housing to a variable distance, wherein a portion of said pull-cord passes through the pull-cord escape port while an inner end thereof is attached to said cord storage spool;

said rotatable outer cover being pivotally mounted to said frame structure and wherein an axis of the rotatable outer cover is aligned with the respective axis of said axle shaft, such that the compact high resistance fitness device is held stationary during use and rotation of the user adjustable resistance force adjustment knob is engaged to set the adjustable resistance of the slip-clutch, so that extension of the pull-cord rotates the spool, rotating the one-way clutch bearing in the locked direction which rotates the rotatable friction plates which are being resisted by said friction of the friction pads engaged therewith and the stationary friction plates engaged with said friction pads.

23. The compact high resistance fitness device according to claim 22, wherein a spirally wound rewind spring is employed to power the rewinding of said pull-cord as it is connected to said cord storage spool and also to said frame structure.

24. The compact high resistance fitness device according to claim 22, wherein said friction between said rotatable friction plates and said stationary friction plates and said friction pads engaged therebetween results from pressure applied by compression springs on said stack of said stationary friction plates and said rotatable friction plates and said friction pads engaged therebetween.

25. The compact high resistance fitness device according to claim 24, wherein said adjustable resistance force adjustment knob drives a spring pressure collar having an internal thread so that said spring pressure collar moves axially along said axis of said axle shaft and causes said compression springs to be compressed when said adjustable resistance force adjustment knob is turned in one direction.

26. The compact high resistance fitness device according to claim 1, wherein a rewind speed control dampener is engaged with said pull cord coil storage spool, which resists rewind of the pull cord coil storage spool to control a rewind speed thereof.

27. The compact high resistance fitness device according to claim 1, wherein a rewind speed control dampener is engaged with said pull cord coil storage spool, which resists rewind of the pull cord coil storage spool to control a rewind speed thereof.

28. A compact high resistance fitness device, comprising:

a platform base plate having opposing first and second ends comprised of base plate segments each extending in a longitudinal direction and having opposite first and second surfaces that extend in said longitudinal direction with said second surfaces facing away from said first surfaces, said base plate segments having opposite outer ends that define said first and second ends of said platform base plate and having adjacent inner ends pivotally joined together so as to be foldable between an aligned flat position with said first surfaces and second surfaces being aligned flat in said longitudinal direction and a folded position with said first surfaces facing each other for storage and said second surfaces facing in opposite directions away from said first surfaces;

each of said first and second ends including a resistance module mounted on a respective one of the opposing ends of the platform base plate wherein each said resistance module is mounted to a respective one of the base plate segments of the platform base plate with said resistance module being located on a respective side of the base plate section defined by said second surface so that said first surfaces are foldable flat against each other;

each said resistance module including a frame structure, an axle shaft supported by said frame structure, a one-way clutch bearing mounted to said axle shaft, a user adjustable resistance force adjustment knob, and a variable resistance rotary slip-clutch having a stack of stationary friction plates and rotatable friction plates that are engaged with friction pads therebetween wherein one said friction pad is disposed between each adjacent pair of one said stationary friction plate and one said rotatable friction plate, said one stationary friction plate and said one rotatable plate of said adjacent pair being engaged in contact with opposite sides of said one friction pad wherein friction is generated between each said friction pad and said one stationary friction plate and said one rotatable plate engaged with said opposite sides thereof to generate friction therebetween to resist rotation of said rotatable friction plates;

said rotatable friction plates being rotationally engaged with said one-way bearing and said stationary friction plates being non-rotationally engaged with said frame structure;

said resistance force adjustment knob being engaged with said slip-clutch to set the adjustable resistance force of said slip-clutch so that each of said resistance module has an independent user-selectable resistance setting which is settable within an incremental resistance range;

each resistance module including a pull cord coil storage spool configured to wrap and unwrap a high-strength pull cord during retraction and extension of said pull cord, said cord storage spool being rotatably mounted to said axle shaft for rotation about a respective axis of said axle shaft and engaged with said one-way clutch bearing so that extension of the pull-cord rotates the spool, rotating the one-way clutch bearing in a locked direction which rotates the rotatable friction plates which are being resisted by said friction of the friction pads engaged therewith and the stationary friction plates engaged with said friction pads, said high-strength pull cord emanating from the resistance module, and said high-strength pull cord terminating at its outer end by a hand/foot receptacle with a length, which allows pull cord strokes having a variable length, said user adjustable resistance force adjustment knob being adjustable to set said resistance force acting on said cord, which resists said pull cord strokes of said cord; and a rotatable housing cover provided external to the at least one resistance module and having a cord escape port orifice for directing and delivering the high-strength pull cord, said rotatable housing cover being adapted to rotate about an axis extending in said longitudinal direction to move the cord exit orifice angle to minimize cord wear.

29. The compact high resistance fitness device according to claim 28, wherein a spirally wound rewind spring is employed to power the rewinding of said pull-cord as it is connected to said cord storage spool and also to said frame structure.

30. The compact high resistance fitness device according to claim 28, wherein said friction between said rotatable friction plates and said stationary friction plates and said friction pads engaged therebetween results from pressure applied by compression springs on said stack of said stationary friction plates and said rotatable friction plates and said friction pads engaged therebetween.

31. The compact high resistance fitness device according to claim 28, wherein said adjustable resistance force adjustment knob drives a spring pressure collar having an internal thread so that said spring pressure collar moves axially along said axis of said axle shaft and causes said compression springs to be compressed when said adjustable resistance force adjustment knob is turned in one direction.

* * * * *